US009309067B2

(12) United States Patent
Tahara

(10) Patent No.: US 9,309,067 B2
(45) Date of Patent: Apr. 12, 2016

(54) SHEET FEED APPARATUS, AND IMAGE FORMING APPARATUS AND IMAGE READING APPARATUS INCLUDING THE SHEET FEED APPARATUS

(71) Applicant: KYOCERA Document Solutions Inc., Osaka-shi, Osaka (JP)

(72) Inventor: Mitsuhiro Tahara, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/313,941

(22) Filed: Jun. 24, 2014

(65) Prior Publication Data

US 2015/0001787 A1 Jan. 1, 2015

(30) Foreign Application Priority Data

Jun. 27, 2013 (JP) ..... 2013-135050

(51) Int. Cl.

| | |
|---|---|
| ***B65H 3/06*** | (2006.01) |
| ***B65H 1/04*** | (2006.01) |
| ***B65H 3/52*** | (2006.01) |
| ***B65H 3/32*** | (2006.01) |
| ***B65H 5/06*** | (2006.01) |

(52) U.S. Cl.

CPC ..... *B65H 3/0684* (2013.01); *B65H 1/04* (2013.01); *B65H 3/32* (2013.01); *B65H 3/5223* (2013.01); *B65H 5/062* (2013.01); *B65H 2405/324* (2013.01); *B65H 2801/06* (2013.01)

(58) Field of Classification Search

CPC ..... B65H 2404/2532; B65H 2404/551; B65H 2404/5511; B65H 2601/324

See application file for complete search history.

(56) References Cited

U.S. PATENT DOCUMENTS

| | | | | |
|---|---|---|---|---|
| 2007/0001376 | A1 | 1/2007 | Lim et al. | |
| 2011/0127710 | A1 | 6/2011 | Yamomoto et al. | |
| 2011/0148028 | A1* | 6/2011 | Arimura et al. | 271/109 |
| 2013/0277907 | A1 | 10/2013 | Yamomoto et al. | |

FOREIGN PATENT DOCUMENTS

| | | | |
|---|---|---|---|
| JP | 2001039587 | A | 2/2001 |
| JP | 2001088965 | A | 4/2001 |
| JP | 2006176320 | A | 7/2006 |
| JP | 2011132035 | A | 7/2011 |
| JP | 2011189995 | A | 9/2011 |

OTHER PUBLICATIONS

European Patent Office, Extended European Search Report of EP14173864.1, Dec. 17, 2014, 7 pages.

* cited by examiner

*Primary Examiner* — Howard Sanders

(74) *Attorney, Agent, or Firm* — Alleman Hall McCoy Russell & Tuttle LLP

(57) ABSTRACT

In a sheet feed apparatus, sheet feed roller is provided in casing so as to face downstream side of sheet stacking portion in sheet conveying direction, and conveys sheets in sheet conveying direction. Separation pad is provided facing sheet feed roller, forms, with sheet feed roller, nip portion through which sheets pass, and conveys sheets one by one in sheet conveying direction. Holder fixes and supports separation pad. Mount portion mounts holder. An urging member urges separation pad toward sheet feed roller via the holder. Holder is changeable in its posture between a first posture in which separation pad is spaced apart from sheet feed roller so as to release nip portion having been formed therebetween, and a second posture in which nip portion is formed between separation pad and sheet feed roller. Holder includes a contact part that contacts the mount portion in the second posture.

16 Claims, 16 Drawing Sheets

SHEET FEED APPARATUS, AND IMAGE FORMING APPARATUS AND IMAGE READING APPARATUS INCLUDING THE SHEET FEED APPARATUS

INCORPORATION BY REFERENCE

This application is based upon and claims the benefit of priority from the corresponding Japanese Patent Application No. 2013-135050 filed on Jun. 27, 2013, the entire contents of which are incorporated herein by reference.

BACKGROUND

The present disclosure relates to sheet feed apparatuses configured to feed sheets, and image forming apparatuses and image reading apparatuses including the sheet feed apparatuses.

To date, as a sheet feed apparatus for feeding sheets, a sheet feed apparatus mounted to an image forming apparatus has been known. The sheet feed apparatus feeds sheets contained in a sheet tray, one by one, in a sheet conveying direction. Each sheet passes through a separation nip portion formed between a sheet feed roller and a separation pad, and is conveyed downstream in the sheet conveying direction. The separation pad is urged by a spring member toward the sheet feed roller. When the sheet passes through the separation nip portion, abnormal sound is likely to occur due to vibration of the separation pad. In order to reduce occurrence of such abnormal sound, a technique has been known in which a vibration absorbing member is attached in the vicinity of a separation pad. In addition, a technique has been known in which a separation pad is supported by a support member, and is mountable/removable with respect to a sheet feed apparatus.

SUMMARY

A sheet feed apparatus according to an aspect of the present disclosure includes a casing, a sheet stacking portion, a sheet conveying path, a sheet feed roller, a separation pad, a holder, a mount portion, and an urging member. The sheet stacking portion is provided in the casing, and sheets are stacked thereon. The sheet conveying path is a conveyance path through which the sheets stacked in the sheet stacking portion are conveyed in a predetermined sheet conveying direction. The sheet feed roller is provided in the casing so as to face a downstream side of the sheet stacking portion in the sheet conveying direction, and conveys the sheets in the sheet conveying direction. The separation pad is provided facing the sheet feed roller, forms, with the sheet feed roller, a nip portion through which the sheets pass, and conveys the sheets one by one in the sheet conveying direction. The holder fixes and supports the separation pad. The mount portion is provided in the downstream side from the sheet stacking portion in the sheet conveying direction in the casing, and is configured such that the holder is mountable to and removable from the mount portion. The urging member urges the separation pad toward the sheet feed roller via the holder being in a mounted state where the holder is mounted to the mount portion. The holder is configured to be changeable in its posture between a first posture and a second posture. In the first posture, the separation pad is spaced apart from the sheet feed roller so as to release the nip portion while the holder is in the mounted state. In the second posture, the nip portion is formed between the separation pad and the sheet feed roller while the holder is in the mounted state. The holder includes a contact part that contacts the mount portion when the holder is in the second posture.

An image forming apparatus according to another aspect of the present disclosure includes the sheet feed apparatus and an image forming portion. The image forming portion is provided in the casing, and forms an image on the sheet conveyed by the sheet feed apparatus.

An image reading apparatus according to still another aspect of the present disclosure includes the sheet feed apparatus configured to convey the sheet as a document sheet, and a reading portion. The reading portion is provided facing the sheet conveying path, and reads an image on the document sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
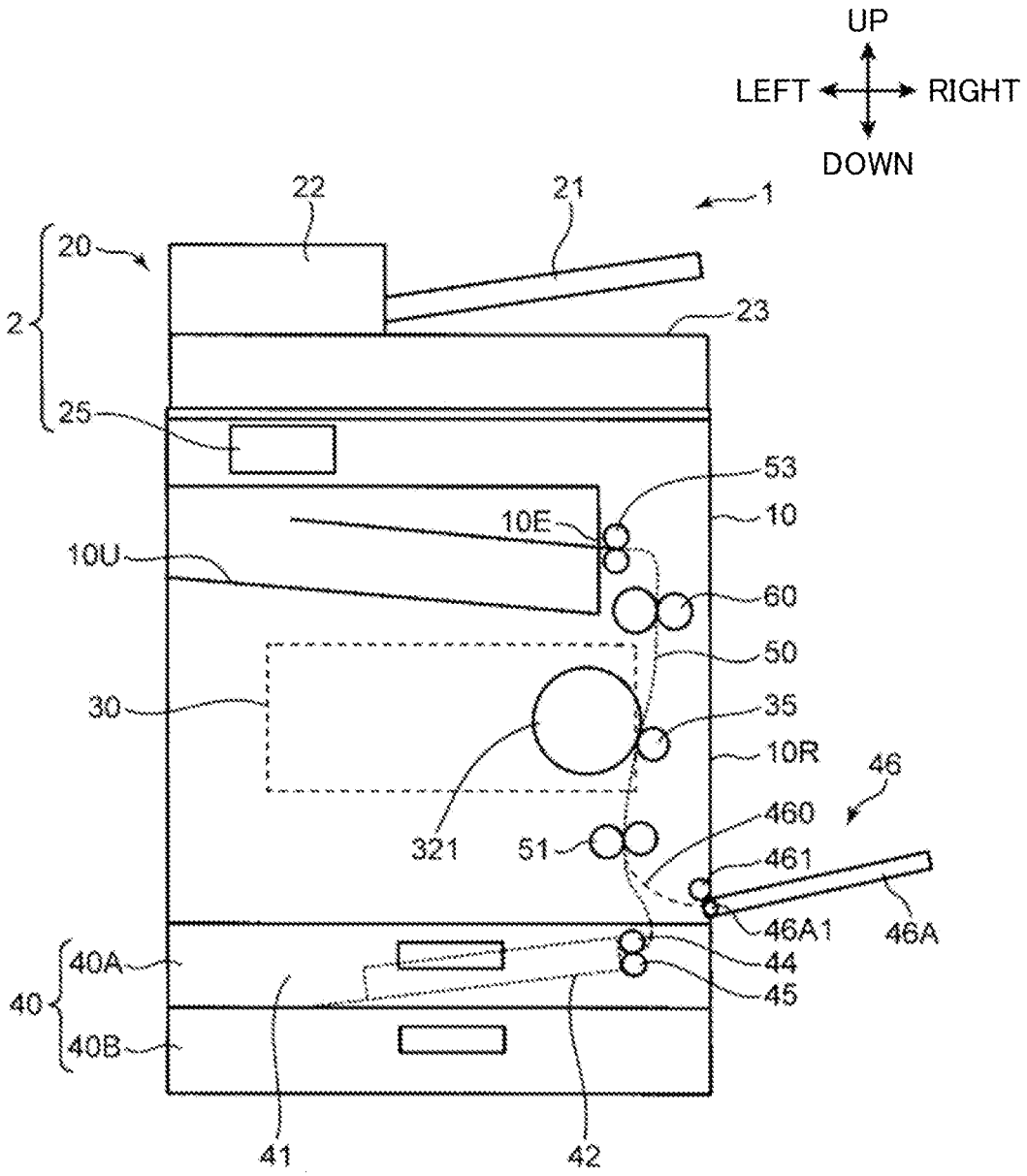
FIG. 1 is a schematic cross-sectional view showing a configuration of an image forming apparatus according to an embodiment of the present disclosure.

Hereinafter, embodiments of the present disclosure will be described in detail based on the drawings. FIG. 1 is a schematic cross-sectional view showing an internal configuration of an image forming apparatus 1 according to an embodiment of the present disclosure. In FIG. 1, a multifunction peripheral having a printing function and a copying function is illustrated as the image forming apparatus 1. However, the image forming apparatus may be a printer, a copy machine, a facsimile apparatus, or the like.

<Description of Image Forming Apparatus>

The image forming apparatus 1 includes an apparatus body (casing) 10, and an ADF (automatic document feeder) 20. The apparatus body 10 has a casing structure having a substantially rectangular parallelepiped shape. The ADF 20 is disposed above the apparatus body 10. Inside the apparatus body 10, a reading unit 25 (reading portion), an image forming portion 30, a fixing portion 60, a sheet feed portion 40, and a conveying path 50 are provided. The reading unit 25 optically reads a document image to be copied. The image forming portion 30 forms a toner image on a sheet. The fixing portion 60 fixes the toner image on the sheet. The sheet feed portion 40 stores standard-size sheets to be conveyed to the image forming portion 30. The conveying path 50 is a conveying route in which the standard-sized sheets are conveyed from the sheet feed portion 40 or a manual sheet feed portion 46 to a sheet discharge outlet 10E via the image forming portion 30 and the fixing portion 60.

The ADF 20 is rotatably attached to a top surface of the apparatus body 10. The ADF 20 automatically feeds a document sheet to be copied toward a predetermined document reading position in the apparatus body 10. On the other hand, when a user manually places a document sheet on the predetermined document reading position, the ADF 20 is opened upward. The ADF 20 includes a document tray 21, a document conveying portion 22, and a document discharge tray 23. A document sheet is placed on the document tray 21. The document conveying portion 22 conveys the document sheet via the document reading position. To the document discharge tray 23, the document sheet having been read is discharged.

On the top surface of the apparatus body 10, a contact glass (not shown) for reading of the document sheet automatically fed by the ADF 20 or a contact glass (not shown) for reading of the document sheet manually placed is disposed. The reading unit 25 optically reads an image on the document sheet through the contact glasses. The ADF 20 and the reading unit 25 form an image reading apparatus 2 described below.

The image forming portion 30 generates a toner image and forms the toner image on a sheet according to a publicly known electrophotographic method. In another embodiment, another image forming method such as an inkjet method may be employed. The image forming portion 30 includes a photosensitive drum 321, and a charging device, an exposure device, a developing device, a cleaning device, and the like, which are not shown, arranged around the photosensitive drum 321.

The photosensitive drum 321 rotates around its axis, and has a circumferential surface on which an electrostatic latent image and a toner image are formed. As the photosensitive drum 321, a photosensitive drum formed of an amorphous-silicon-(a-Si)-based material may be used. The charging device uniformly charges the surface of the photosensitive drum 321. The exposure device includes a laser light source and optical devices such as a mirror and a lens. The exposure device irradiates the circumferential surface of the photosensitive drum 321 with light based on image data of a document image to form an electrostatic latent image. The developing device supplies toner to the circumferential surface of the photosensitive drum 321 to develop the electrostatic latent image formed on the photosensitive drum 321. The developing device uses a two-component developer, and includes a screw feeder, a magnetic roller, and a developing roller. The cleaning device includes a cleaning roller and the like, and cleans the circumferential surface of the photosensitive drum 321 from which the toner image has been transferred. A transfer roller 35 is disposed facing the photosensitive drum 321. At a transfer nip portion between the photosensitive drum 321 and the transfer roller 35, the toner image on the photosensitive drum 321 is transferred onto a sheet. A secondary transfer bias voltage having a polarity opposite to that of the toner image is applied to the transfer roller 35.

The sheet feed portion 40 includes two-stage sheet feed cassettes, that is, a first sheet feed cassette 40A and a second sheet feed cassette 40B, which store therein standard-size sheets P among sheets to be subjected to image forming processing. These sheet feed cassettes can be drawn toward the near side of the paper face of FIG. 1 from the front of the apparatus body 10.

The first sheet feed cassette 40A includes a sheet storage portion 41 and a lifting plate 42. The sheet storage portion 41 stores a sheet stack of standard-size sheets P. The lifting plate 42 lifts up the sheet stack for sheet feeding. At an upper portion on the right end side of the sheet feed cassette 40A, a not-illustrated pick-up roller and a roller pair including a sheet feed roll 44 and a retard roller 45 are disposed. The uppermost sheet P of the sheet stack stored in the sheet feed cassette 40A is fed one by one by driving of the pickup roller and the sheet feed roll 44, and conveyed to an upstream end of the conveying path 50. The second sheet feed cassette 40B has the same structure as the first sheet feed cassette 40A.

On a right side surface 10R of the apparatus body 10, a manual sheet feed portion 46 (sheet feed apparatus) is disposed. The manual sheet feed portion 46 conveys a sheet toward the image forming portion 30. The manual sheet feed portion 46 includes a manual feed tray 46A (sheet stacking portion) for manual sheet feeding, and a sheet feed roller 461. Sheets are stacked in the manual feed tray 46A. The manual feed tray 46A is mounted to the apparatus body 10 so as to be openable and closable around a fulcrum portion 46A1 provided at a lower end of the manual feed tray 46A. When a user performs manual sheet feeding, the user opens the manual feed tray 46A as shown in FIG. 1, and places a sheet thereon. The sheet placed on the manual feed tray 46A is conveyed into a manually-fed-sheet conveying path 460 (sheet conveying path) by the sheet feed roller 461 being driven. The manually-fed-sheet conveying path 460 is a conveying path extending from the manual feed tray 46A, through which a sheet is conveyed in a predetermined sheet conveying direction. The sheet conveyed in the sheet conveying direction passes through the manually-fed-sheet conveying path 460 and enters the conveying path 50. The sheet feed roller 461 is driven to rotate, and conveys the sheet in the sheet conveying direction. The sheet feed roller 461 is mounted to the apparatus body 10. In the manual feed tray 46A, the sheet feed roller 461 is disposed facing a portion on the downstream side in the sheet conveying direction.

The conveying path 50 is extended from the sheet feed portion 40 to the sheet discharge outlet 10E via the image forming portion 30 and the fixing portion 60. A registration roller pair 51 is disposed upstream of the conveying path 50 relative to the transfer nip portion. The sheet is temporarily stopped at the registration roller pair 51 that is at a stop, where skew correction is performed. Thereafter, the registration roller pair 51 is driven to rotate by a driving motor (not shown) at a predetermined time for image transfer, thereby feeding the sheet to the transfer nip portion. In addition, a plurality of sheet conveying rollers (not shown) for conveying sheets are disposed in the conveying path 50.

A sheet discharge roller 53 is disposed at the end, on the most downstream side, of the conveying path 50. The sheet discharge roller 53 discharges a sheet P through the sheet discharge outlet 10E. The sheet P is discharged through the sheet discharge outlet 10E to a sheet discharge portion 10U and stacked therein.

The fixing portion 60 performs fixing processing to fix a toner image on the sheet. A pressure roller is pressed against a not-illustrated fixing roller to form a fixing nip portion. When the sheet passes through the fixing nip portion, the toner image transferred to the sheet is fixed on the sheet.

<Manual Sheet Feed Portion>

Figure 2:
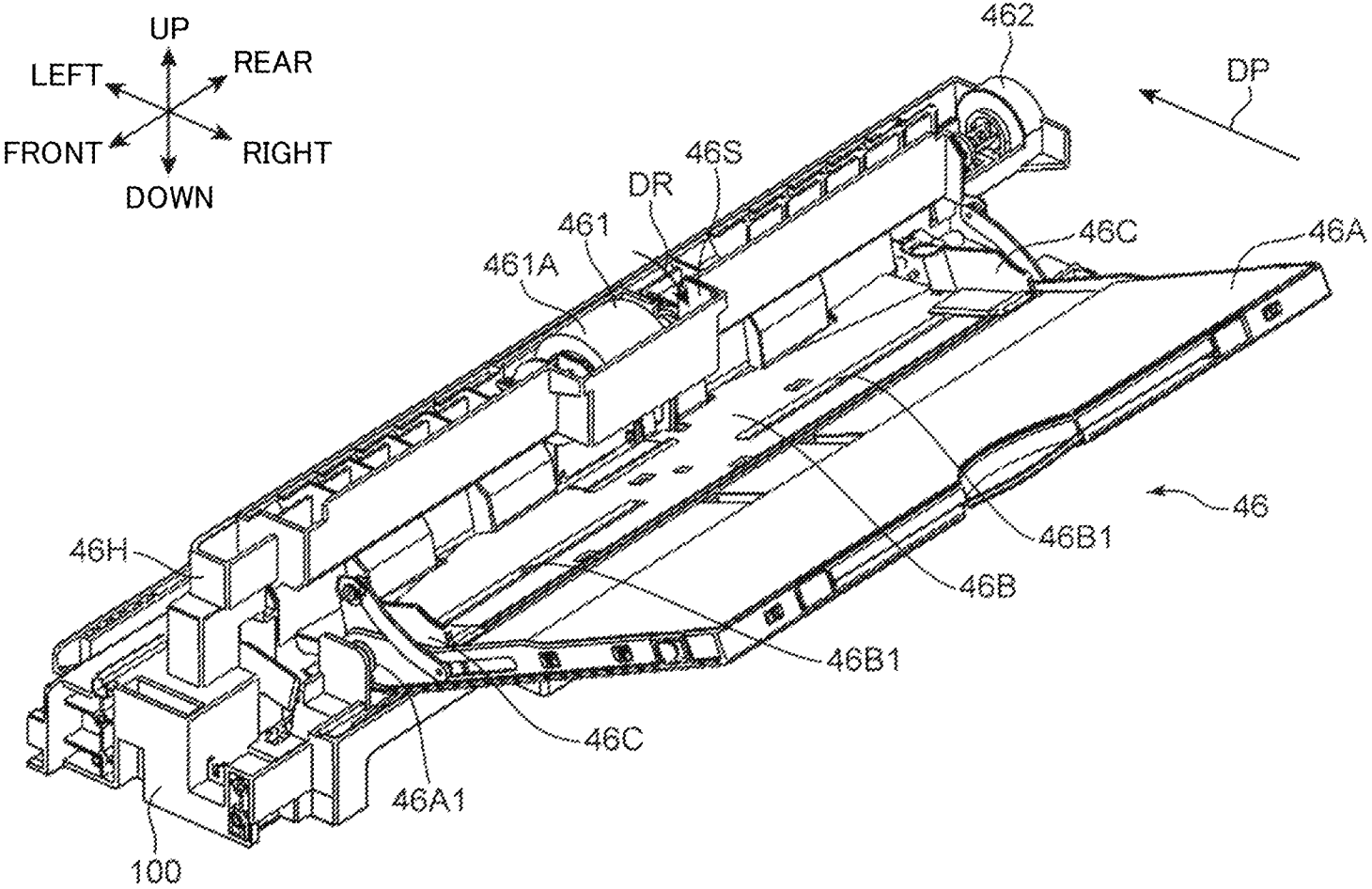
FIG. 2 is a perspective view of a manual sheet feed portion according to the embodiment of the present disclosure.
Figure 3:
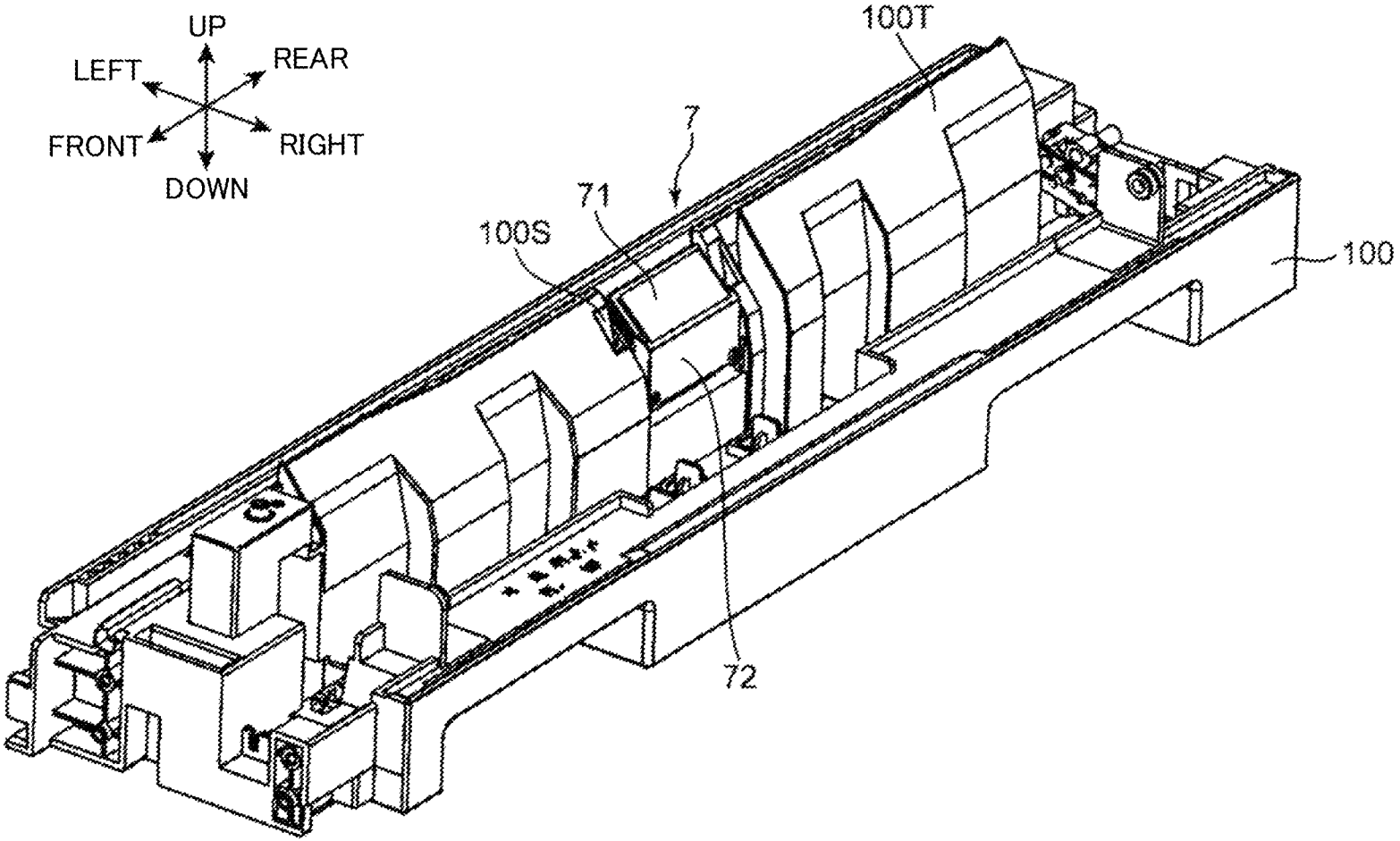
FIG. 3 is an internal perspective view of the manual sheet feed portion according to the embodiment of the present disclosure.
Figure 4:
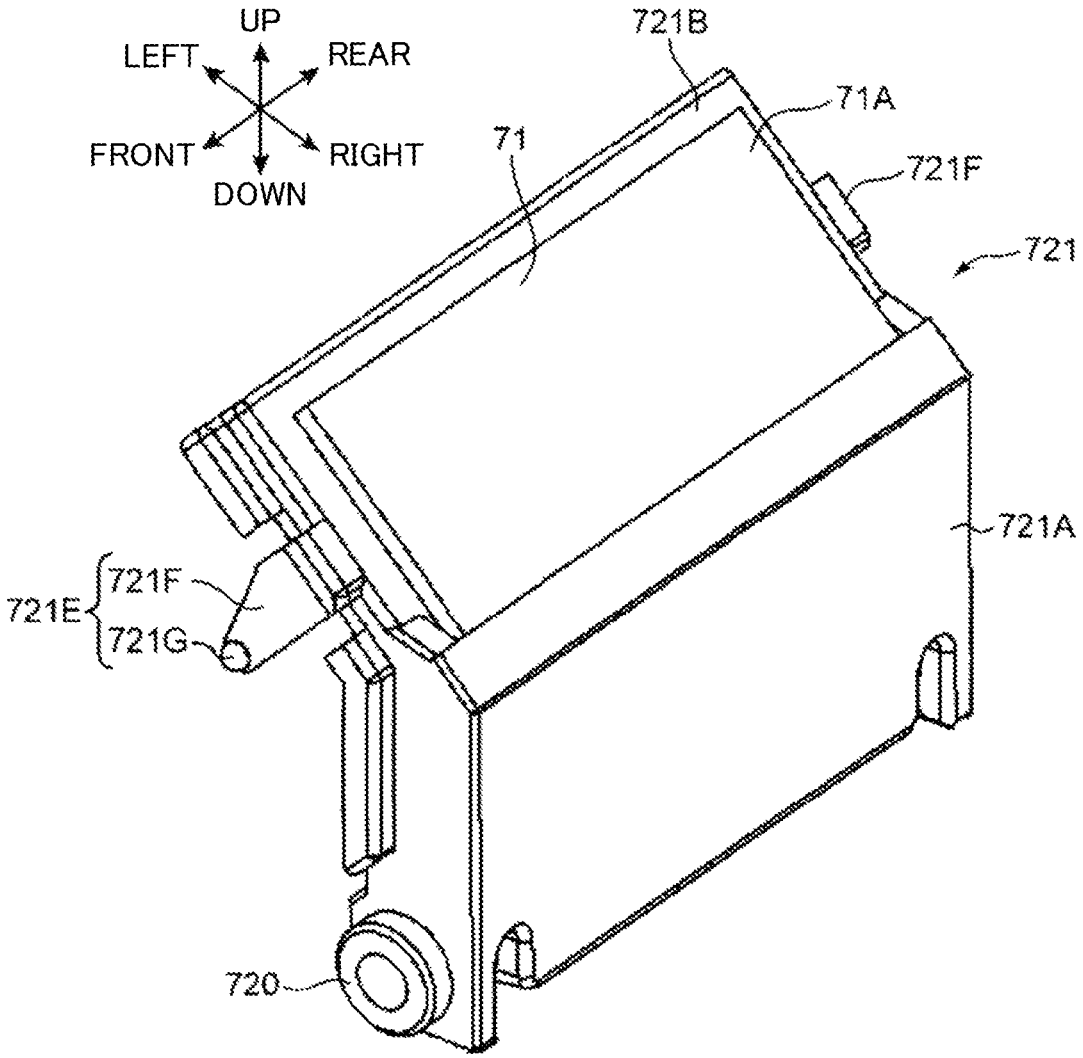
FIG. 4 is a perspective view of a first supporting plate of a holder according to the embodiment of the present disclosure.
Figure 5:
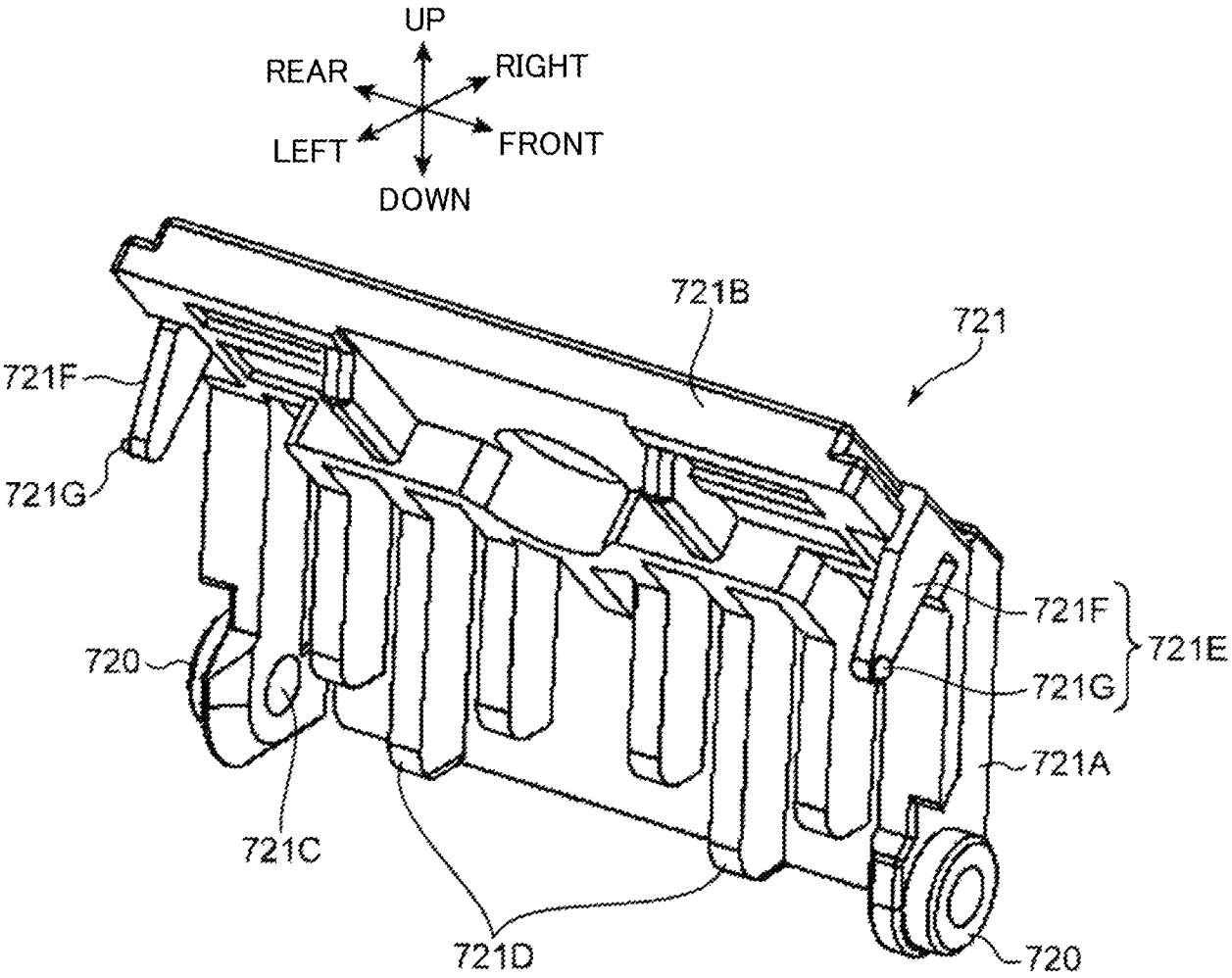
FIG. 5 is a perspective view of the first supporting plate of the holder according to the embodiment of the present disclosure.
Figure 6:
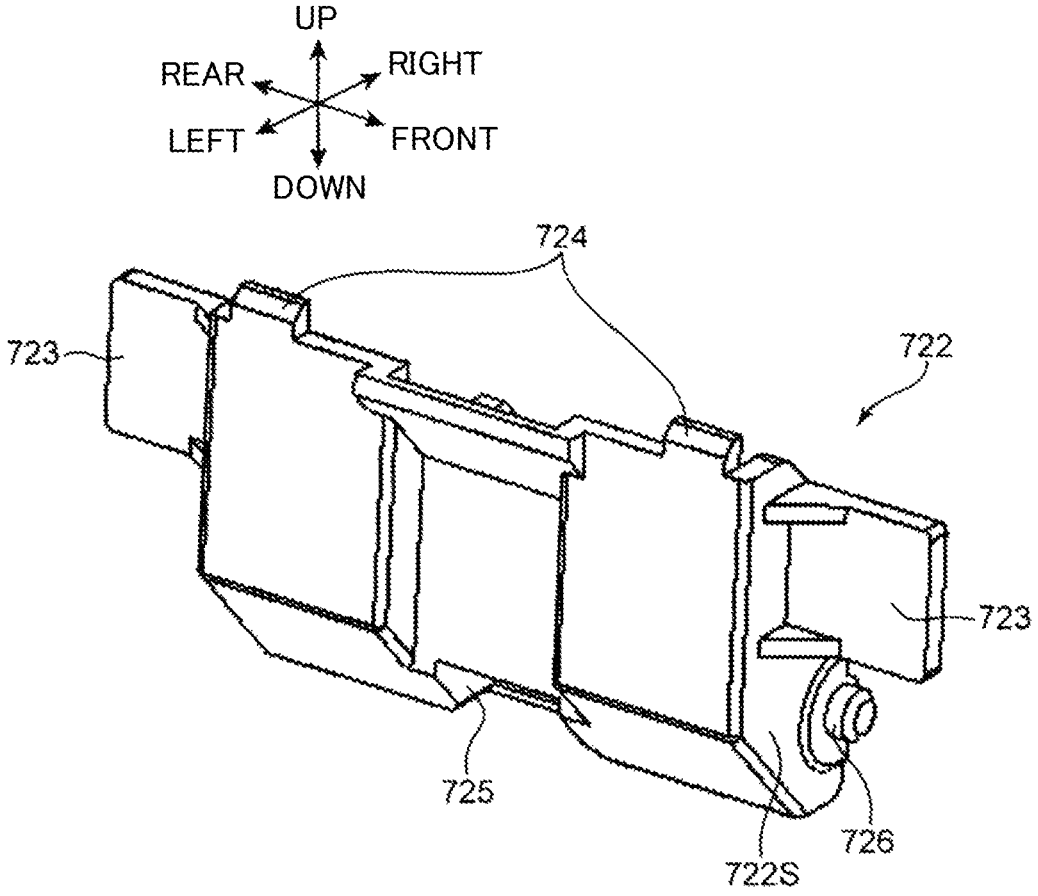
FIG. 6 is a perspective view of a second supporting plate of the holder according to the embodiment of the present disclosure.
Figure 7:
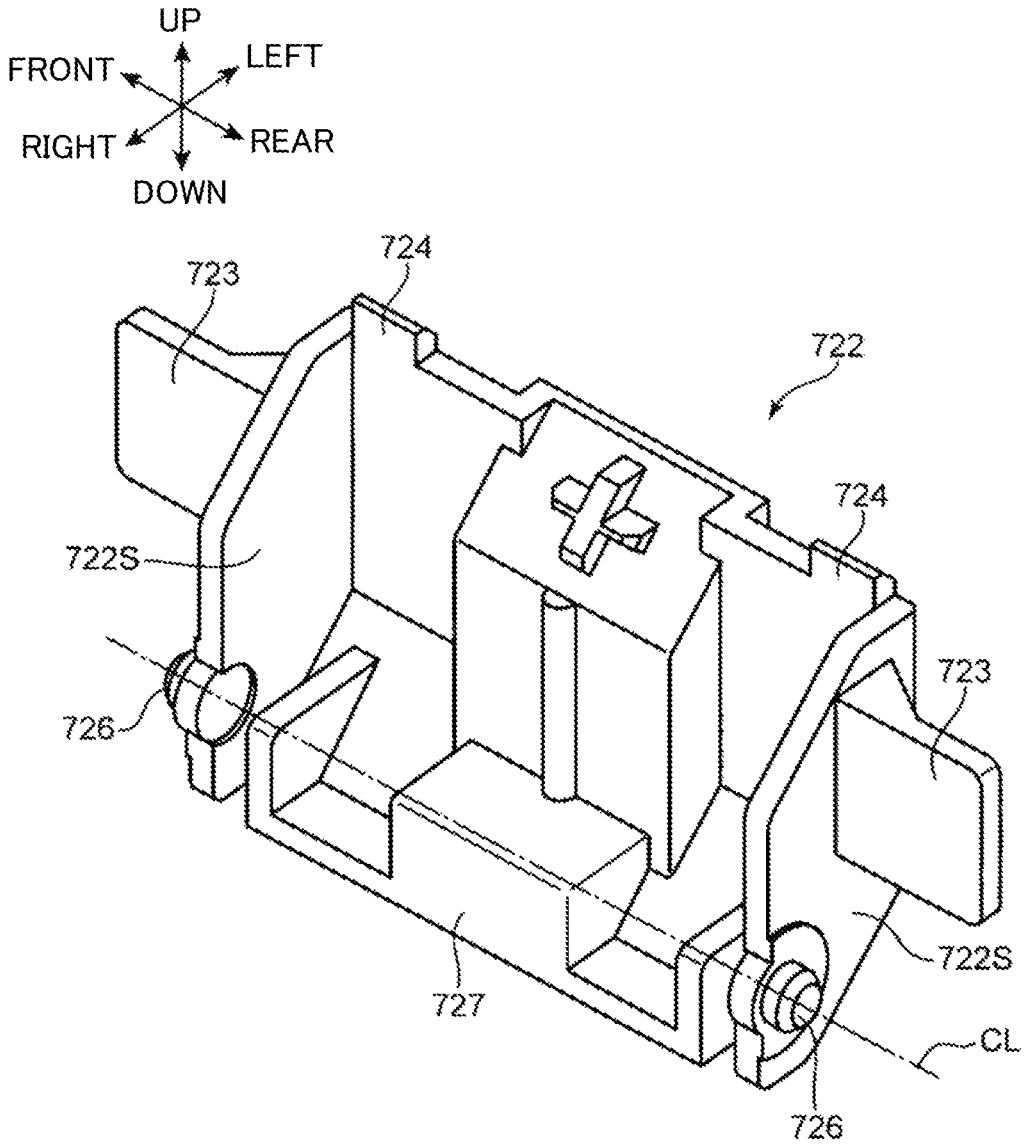
FIG. 7 is a perspective view of the second supporting plate of the holder according to the embodiment of the present disclosure.
Figure 8:
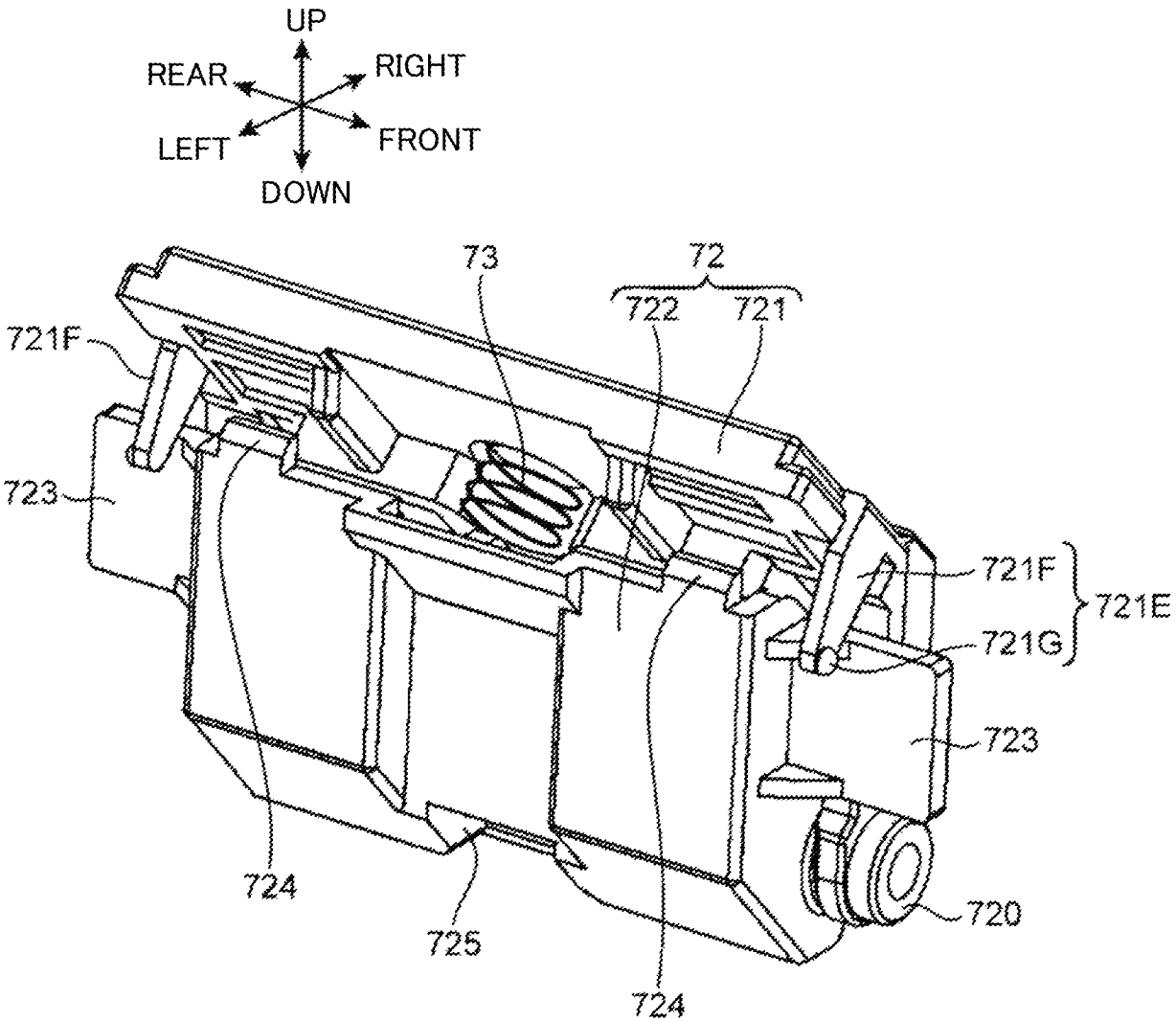
FIG. 8 is a perspective view of the holder according to the embodiment of the present disclosure.
Figure 9:
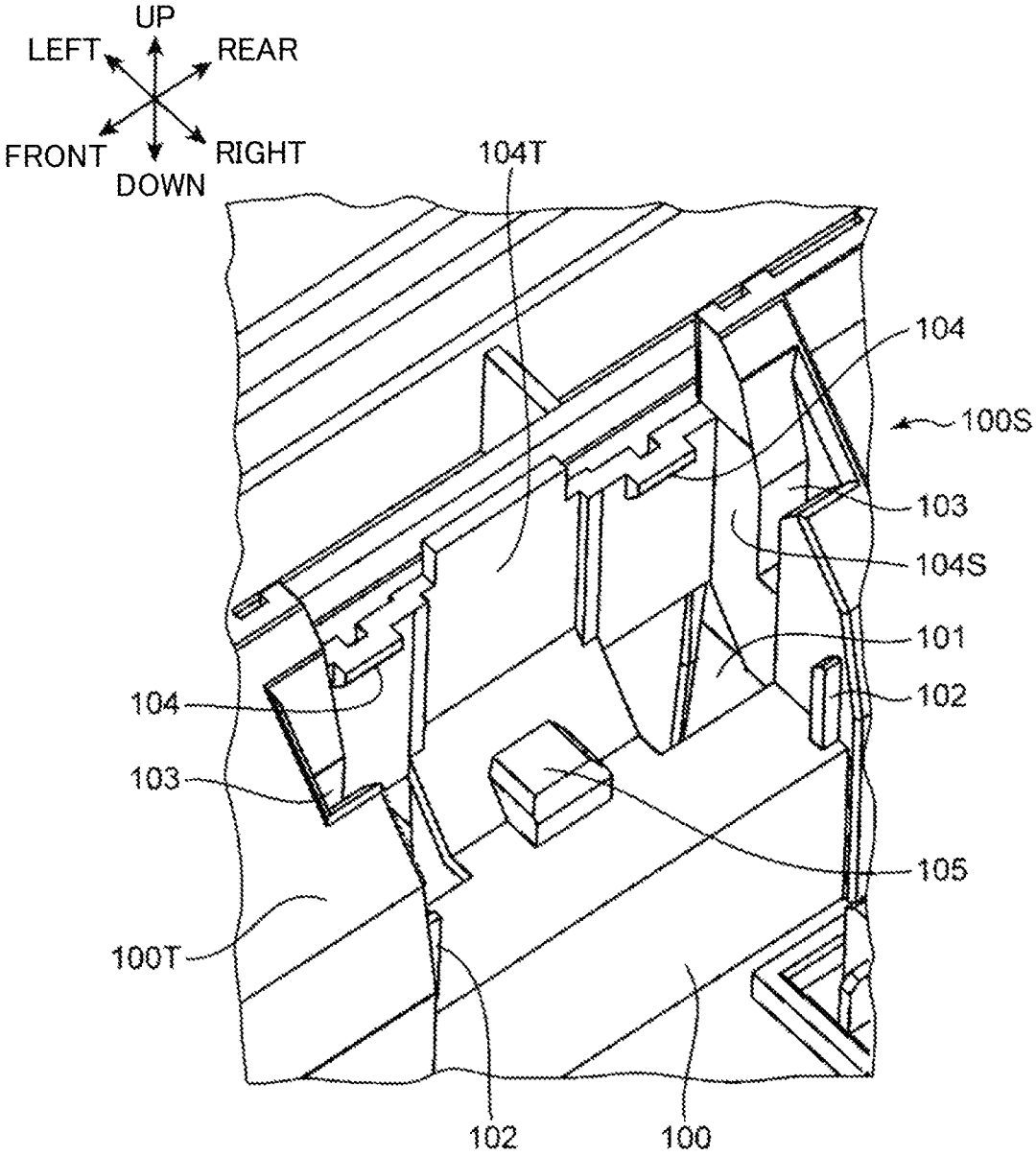
FIG. 9 is a perspective view of a mount portion according to the embodiment of the present disclosure.

Next, with reference to FIGS. 2 to 9, the manual sheet feed portion 46 according to the present embodiment will be described in detail. FIG. 2 is a perspective view of the manual sheet feed portion 46 according to the present embodiment. FIG. 3 is a perspective view of the inside (main unit 100) of the manual sheet feed portion 46 from which a later-described housing 46H is removed. FIG. 4 is a perspective view of a first holder portion 721 of a later-described pad holder 72, seen from the right side. FIG. 5 is a perspective view of the first holder portion 721 seen from the left side. FIG. 6 is a perspective view of a later-described second holder portion 722 seen from the left side. FIG. 7 is a perspective view of the second holder portion 722 seen from the right side. FIG. 8 is a perspective view of the pad holder 72 including the first holder portion 721 and the second holder portion 722 being combined, seen from the left side. FIG. 9 is an enlarged perspective view of a mount portion 100S to which the pad holder 72 is to be mounted.

With reference to FIG. 2, the manual sheet feed portion 46 includes the main unit 100, the manual feed tray 46A, a manual feed lifting plate 46B, width regulation guides 46C, the sheet feed roller 461, and a housing 46H.

The main unit 100 is a casing disposed on the right side surface 10R (FIG. 1) of the apparatus body 10. The main unit 100 forms a part of the apparatus body 10. As shown in FIG. 3, the main unit 100 is disposed so as to extend in the front-rear direction with a predetermined width in the left-right direction. A guide surface 100T (FIG. 3) is disposed in a center portion of the main unit 100. The guide surface 100T is a wall surface that defines a lower side of the manually-fed-sheet conveying path 460, in a region downstream of the manual feed tray 46A in the sheet conveying direction. A sheet is guided leftward and upward by the guide surface 100T.

The above-mentioned manual feed tray 46A is a plate-shaped member that is openable and closable with respect to the main unit 100. The manual feed tray 46A is rotatable around the fulcrum portion 46A1 (FIG. 2). A sheet is conveyed from the manual feed tray 46A in a direction of an arrow DP in FIG. 2 (sheet conveying direction, hereinafter also simply referred to as conveying direction).

The manual feed lifting plate 46B forms a part of a top surface portion of the manual feed tray 46A, and is disposed on the left side (downstream side in the sheet conveying direction) of the manual feed tray 46A. A left end portion of the manual feed lifting plate 46B is movable up and down by a non-illustrated driving mechanism. By the up-down movement of the manual feed lifting plate 46B, leading end portions (left end portions) of sheets stacked on the manual feed tray 46A are moved upward. As a result, the leading end portions of the sheets contact the sheet feed roller 461.

The width regulation guides 46C are disposed on the manual feed lifting plate 46B. The width regulation guides 46C are disposed on the front side and the rear side, respectively, so as to be paired, and regulate a position, in the width direction, of a sheet. The width regulation guides 46C are movable in the front-rear direction along guide grooves 46B1 formed in the manual feed lifting plate 46B via not-illustrated rack and pinion gear.

The sheet feed roller 461 is disposed upstream of the manually-fed-sheet conveying path 460 so as to face the manual feed lifting plate 46B. The sheet feed roller 461 has a circumferential surface 461A that is rotated, and conveys a sheet in the sheet conveying direction.

The housing 46H has a box shape extending in the front-rear direction. The housing 46H is disposed above the guide surface 100T and the mount portion 100S (refer to FIG. 3) of the main unit 100 (refer to FIG. 2). The housing 46H supports the sheet feed roller 461 in the center portion in the front-rear direction such that the sheet feed roller 461 is rotatable. The center portion, in the front-rear direction, of the housing 46H has a shape partially projecting to the right. The housing 46H has, inside the projecting portion, an insertion space 46S (storage space) in which the sheet feed roller 461 is housed. In addition, a driving gear 462 is disposed in the rear end portion of the housing 46H. The driving gear 462 is connected to the sheet feed roller 461 through a not-illustrated shaft. When the driving gear 462 is rotated by a not-illustrated driving motor, the sheet feed roller 461 is rotated through the shaft in the direction of an arrow DR in FIG. 2. Further, the sheet feed roller 461 is mounted in or removed from the insertion space 46S via an upper portion of the insertion space 46S. When the sheet feed roller 461 is removed from the housing 46H, a later-described pad holder 72 can be mounted to or removed from the mount portion 100S via the insertion space 46S of the housing 46H.

With reference to FIG. 3, the manual sheet feed portion 46 further includes a separation pad portion 7. The separation pad portion 7 has a function of handling sheets. In FIG. 2, when the housing 46H is removed from the main unit 100, the separation pad portion 7 is exposed as shown in FIG. 3. The separation pad portion 7 includes a separation pad 71 and a pad holder 72.

The separation pad 71 is disposed facing the circumferential surface 461A of the sheet feed roller 461. The separation pad 71 includes a separation surface 71A (refer to FIG. 4) that forms, with the circumferential surface 461A, a nip portion through which a sheet passes. The separation pad 71 is formed of a plate-shaped elastic member. For example, the separation pad 71 is formed as a rubber member. The separation surface 71A of the separation pad 71 has a high coefficient of friction with respect to a sheet. Due to a frictional force between a sheet and the separation surface 71A, sheets, other than an uppermost sheet, in a stack of sheets are prevented from being conveyed downstream in the sheet conveying direction. In other words, the separation pad 71 allows the sheet feed roller 461 to convey the sheets one by one in the sheet conveying direction.

The pad holder 72 fixes and supports the separation pad 71. In addition, the pad holder 72 is mounted to the mount portion 100S formed in the center portion, in the front-rear direction, of the main unit 100. The mount portion 100S is provided on the guide surface 100T that is positioned in the downstream side from the manual feed tray 46A in the sheet conveying direction (refer to FIG. 3). The mount portion 100S has a mount space 101 in which the pad holder 72 is to be mounted (refer to FIG. 9). The pad holder 72 is mounted to or removed from the mount portion 100S by a user of the image forming apparatus 1 or a maintenance worker.

With reference to FIGS. 4 to 8, the pad holder 72 includes a first holder portion 721 (first supporting plate) and a second holder portion 722 (second supporting plate). The posture of the pad holder 72 is changeable between a first posture and the second posture. The first posture is a posture that the pad holder 72 takes until it is mounted in the mount space 101 of the mount portion 100S. In addition, the first posture is a posture in which the separation pad 71 of the pad holder 72 is spaced apart from the sheet feed roller 461 so as to release the nip portion, with the pad holder 72 being mounted to the mount portion 100S. Specifically, the first posture is a posture in which the separation pad is disposed on the sheet feed roller 461 side when the sheet feed roller 461 is spaced apart from the separation pad 71 of the pad holder 72, with the pad holder 72 being mounted to the mount portion 100S. That is, in the first posture, the sheet feed roller 461 is spaced apart from the separation pad 71. The second posture is a posture in which the nip portion is formed between the separation pad 71 and the sheet feed roller 461 with the pad holder 72 in the first posture being mounted in the mount space 101. In addition, the pad holder 72 slides along main body guide pieces 102 when being mounted to the mount space 101 as described later, and is pressed against the main body guide pieces 102 in the mount space 101 when the nip portion of between the separation pad 71 and the sheet feed roller 461 is formed. Then, the pad holder 72, in the first posture, is in a state where a predetermined gap T (refer to FIG. 12) is formed between the pad holder 72 and each of the main body guide pieces 102 of the mount portion 100S as described later. In addition, the pad holder 72, in the second posture, is in a state where it is pressed against the main body guide pieces 102 in the mount space 101 of the mount portion 100S (refer to FIG. 16).

The first holder portion 721 supports the separation pad 71. The first holder portion 721 is disposed as a right side portion of the pad holder 72. The first holder portion 721 is formed as a plate-shaped member that is bent with a center portion thereof in the up-down direction being a ridge line. The first holder portion 721 includes a first support portion 721A and a second support portion 721B. The first support portion 721A corresponds to a lower portion of the first holder portion 721. The second support portion 721B corresponds to an upper portion of the first holder portion 721. In the second posture of the pad holder 72 corresponding to the sheet feeding operation, the first support portion 721A is disposed so as to extend in substantially vertical direction. In addition, the second support portion 721B is bent at a predetermined angle with respect to the first support portion 721A, and has a surface inclined to the downstream side in the sheet conveying direction, toward an upper portion thereof. As shown in FIG. 4, the second support portion 721B fixes and supports the separation pad 71. The first support portion 721A includes a pair of cylindrical parts 720, a pair of holes 721C, a pair of parts-to-be-engaged 721D, and a pair of contact parts 721E (refer to FIG. 4 and FIG. 5).

Each cylindrical part 720 is disposed so as to project from a lower end portion of the first support portion 721A, in other words, from a portion of the first holder portion 721 lower than the separation pad 71 in the pad holder 72. The pair of cylindrical parts 720 are disposed so as to project in the sheet width direction (front-rear direction) intersecting the sheet conveying direction. Each cylindrical part 720 has an outer circumferential surface 720A (refer to FIG. 12). The pair of holes 721C are opened inside, in the sheet width direction (front-rear direction), with respect to the pair of cylindrical parts 720, respectively. The holes 721C are opened facing the sheet width direction at the lower end side of the first support portion 721A. The holes 721C are communicated with the interiors of the cylindrical parts 720. Although in FIG. 5 only one of the holes 721C is shown, the other hole 721C is provided at the front side as well. The parts-to-be-engaged 721D are lower portions of a pair of ribs disposed at the rear side of the first support portion 721A, and face a later-described engaging part 727 of the second holder portion 722.

The contact parts 721E are disposed on both end portions, in the sheet width direction, of the second support portion 721B of the first holder portion 721. The contact parts 721E are spaced apart from the later-described mount portion 100S in the first posture of the pad holder 72, and contact the mount portion 100S in the second posture of the pad holder 72. Each contact part 721E includes an extending portion 721F and a hemisphere portion 721G (projecting portion). The extending portion 721F is disposed so as to project from an end portion of the first holder portion 721 in the sheet width direction, toward the second holder portion 722. The extending portion 721F is elastically deformable, and a front end thereof is movable in the sheet width direction. The hemisphere portion 721G is disposed so as to project outward in the sheet width direction from the front end of the extending portion 721F. The hemisphere portion 721G has a hemispherical shape that tapers outward in the sheet width direction. The hemisphere portion 721G has a function of coming into contact with later-described inner wall parts 104S. As shown in FIG. 8, the contact part 721E is located above guide pieces 723 of the later-described second holder portion 722.

The second holder portion 722 (refer to FIGS. 6 and 7) is disposed to the left of the first holder portion 721 so as to face the first holder portion 721 (refer to FIG. 8). In other words, the second holder portion 722 is disposed on the side opposite to the sheet feed roller 461(FIG. 2) with respect to the first holder portion 721 so as to face the first holder portion 721. The second holder portion 722 is a plate-shaped member extending in the front-rear direction, and includes a pair of side walls 722S in the front-rear direction.

The second holder portion 722 includes the guide pieces 723 (guide plates), contact pieces 724, a cut portion 725, shafts 726, and an engaging part 727. The guide pieces 723 are a pair of plate-shaped members disposed so as to project in the sheet width direction (front-rear direction) from both end portions, in the sheet width direction, of the second holder portion 722. The guide pieces 723 are disposed so as to extent in the up-down direction. The contact pieces 724 are a pair of projecting pieces disposed so as to project upward from an upper edge of the second holder portion 722. The cut portion 725 is formed by denting upward a center portion of the second holder portion 722 at a lower edge thereof. The cut portion 725 is a dent having a substantially rectangular parallelepiped shape corresponding to a later-described lower support part 105 of the mount portion 100S. Beneath the pair of guide pieces 723, the shafts 726 are extended outward in the sheet width direction (front-rear direction) from the side walls 722S of the second holder portion 722, and can be inserted to the above-mentioned holes 721C. Each shaft 726 is a substantially cylindrical projection. In addition, the engaging part 727 is the rear side of the cut portion 725, and corresponds to a lower end portion of the second holder portion 722.

The pair of shafts 726 of the second holder portion 722 are inserted in the pair of holes 721C (refer to FIG. 5) of the first holder portion 721, and thereby the first holder portion 721 and the second holder portion 722 are connected to each other. At this time, a rotation axis line CL (refer to FIG. 7) is formed between the pair of shafts 726. In other words, the rotation axis line CL is extended in the sheet width direction at the lower end of the second holder portion 722. Then, the first holder portion 721 is rotatable with respect to the second holder portion 722 around the rotation axis line CL. In other words, the first holder portion 721 is supported rotatably around the shafts 726 by the second holder portion 722. The rotation axis line CL is disposed coaxially with the cylindrical axis of the pair of cylindrical parts 720.

Further, the separation pad portion 7 includes an urging spring 73 (urging member) (refer to FIG. 8). The urging spring 73 is a coil spring compressed and disposed between the first holder portion 721 and the second holder portion 722. The urging spring 73 urges the first holder portion 721 upward and rightward. As a result, the separation pad 71 is pressed toward the circumferential surface 461A of the sheet feed roller 461, and thereby a nip portion is formed stably. The urging spring 73 may be disposed on the mount portion 100S side. However, the urging spring 73 being disposed between the first holder portion 721 and the second holder portion 722 allows a nip pressure to be appropriately maintained even in the pad holder 72 that is mountable to and removable from the mount portion 100S. In other words, if the urging spring is fixedly disposed on the mount portion 100S side, the contact position between the mountable/removable pad holder 72 and the urging spring is unstable, and the nip pressure is likely to vary. In addition, when the engaging part 727 of the second holder portion 722 contacts the parts-to-be-engaged 721D of the first holder portion 721, an opening angle between the first holder portion 721 and the second holder portion 722 around the rotation axis line CL is restricted in a predetermined range. In other words, the parts-to-be-engaged 721D of the first holder portion 721 and the engaging part 727 of the second holder portion 722 function as an anti-rotation member of the first holder portion 721.

With reference to FIG. 9, the mount portion 100S includes the mount space 101, the main body guide pieces 102 (guide members), guide grooves 103, upper support parts 104, and a lower support part 105. In addition, the mount portion 100S includes inner wall parts 104S.

The mount space 101 is a space in which the pad holder 72 is to be mounted. The mount space 101 is a space opened upward and to the manual feed tray 46A side (rightward). The main body guide pieces 102 are disposed in the mount portion 100S, and guide the pad holder 72 to the mount space 101 of the mount portion 100S. More specifically, on the upstream side (right side) of the mount space 101 in the sheet conveying direction, the main body guide pieces 102 are disposed, so as to be paired, at both ends of the mount space 101 in the sheet width direction. In the mount portion 100S, the main body guide pieces 102 are disposed between the pad holder 72 and the manual feed tray 46A. The main body guide pieces 102 are a pair of plate-shaped members extending in the up-down direction with a predetermined width in the front-rear direction. The main body guide pieces 102 have wall surfaces 102A (refer to FIG. 12) extending in the up-down direction and facing the pad holder 72, on the side opposite to the manual feed tray 46A (the downstream side in the sheet conveying direction).

The guide grooves 103 are a pair of grooves formed by partially cutting the guide surface 100T at both ends of the mount portion 100S in the front-rear direction. The guide grooves 103 extend in the up-down direction. The guide pieces 723 of the pad holder 72 are inserted in the guide grooves 103. The upper support parts 104 are a pair of projecting pieces disposed so as to project from a wall part 104T of the mount portion 100S on the downstream side (left side) of the mount portion 100S in the sheet conveying direction. The wall part 104T defines the downstream side of the mount space 101 in the sheet conveying direction. The upper support parts 104 are disposed so as to project from the wall part 104T upstream in the sheet conveying direction. In addition, the side surfaces of the upper support parts 104 on the upstream side in the sheet conveying direction each have an inclined surface facing rightward and downward. The contact pieces 724 of the pad holder 72 are engaged with the upper support parts 104. As a result, the second holder portion 722 of the pad holder 72 is fixed to the mount portion 100S. That is, the second holder portion 722 is mounted to the mount portion 100S. The lower support part 105 is a projection disposed at the bottom in the mount space 101 of the mount portion 100S so as to project upward. The lower support part 105 has a substantially rectangular parallelepiped shape. The lower support part 105 is inserted in the cut portion 725 of the pad holder 72. With the lower support part 105 and the cut portion 725, the position of the pad holder 72 in the front-rear direction (sheet width direction) is restricted within a predetermined amount of backlash.

The inner wall parts 104S are a pair of inner wall parts which define the front and rear ends of the mount space 101, and face the pad holder 72 in the sheet width direction. The above-mentioned guide grooves 103 are formed by partially cutting the inner wall parts 104S. The inner wall parts 104S are disposed in a standing manner so as to face in the sheet width direction. In FIG. 9, only the rear-side inner wall part 104S is shown.

Figure 10:
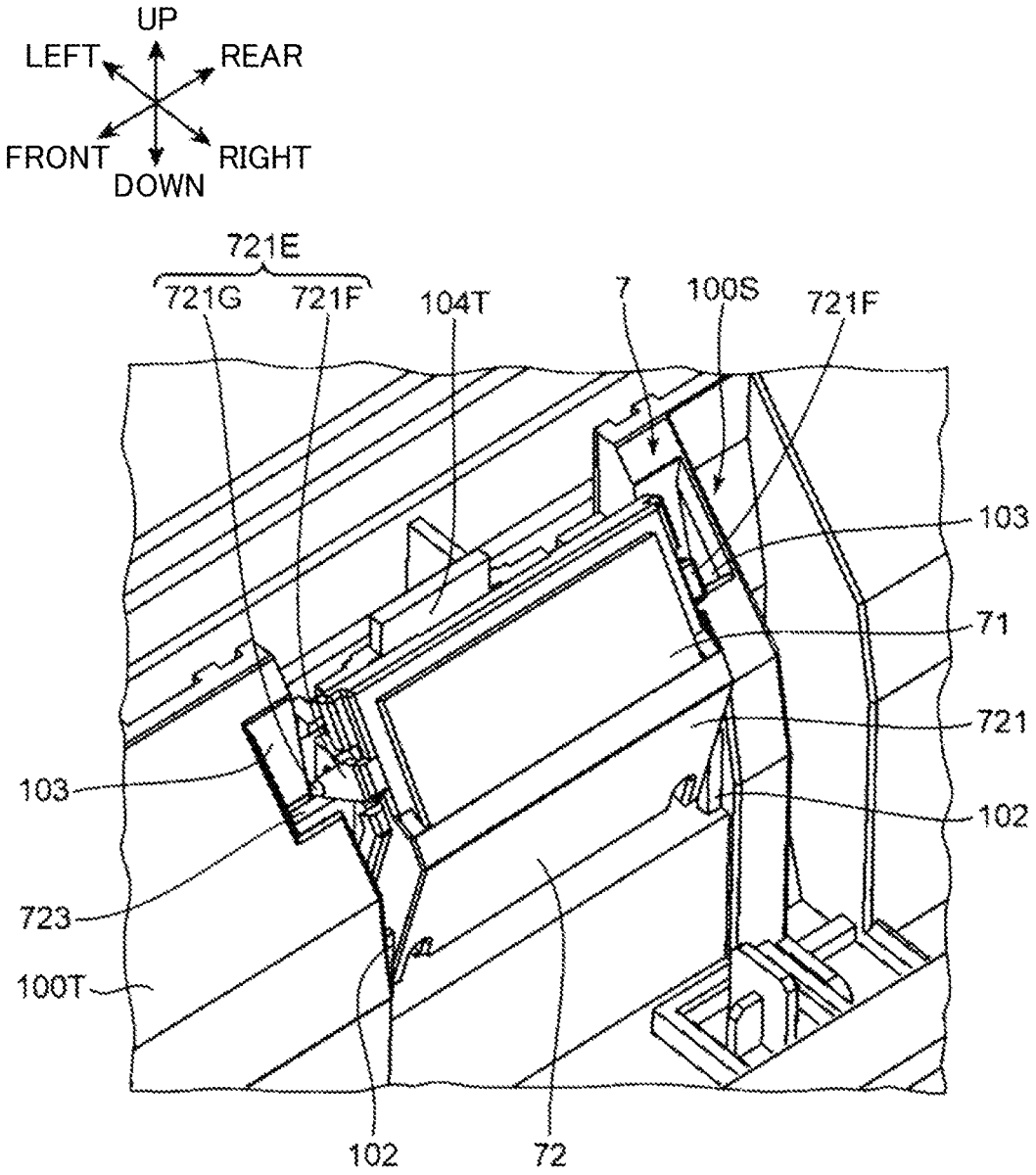
FIG. 10 is a perspective view showing a state where the holder, in its first posture, is mounted to the mount portion, according to the embodiment of the present disclosure.
Figure 11:
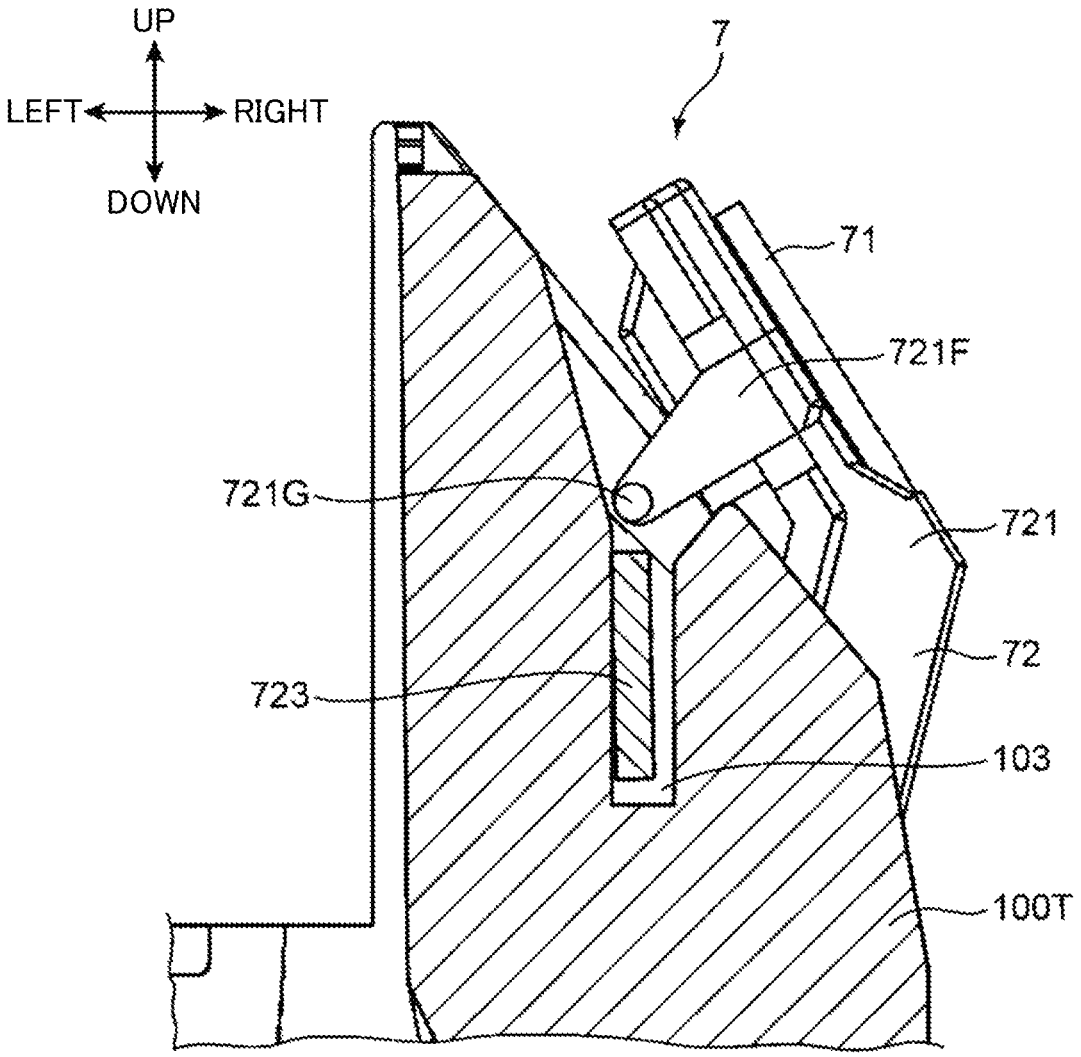
FIG. 11 is a cross-sectional view showing a state where the holder, in the first posture, is mounted to the mount portion, according to the embodiment of the present disclosure.
Figure 12:
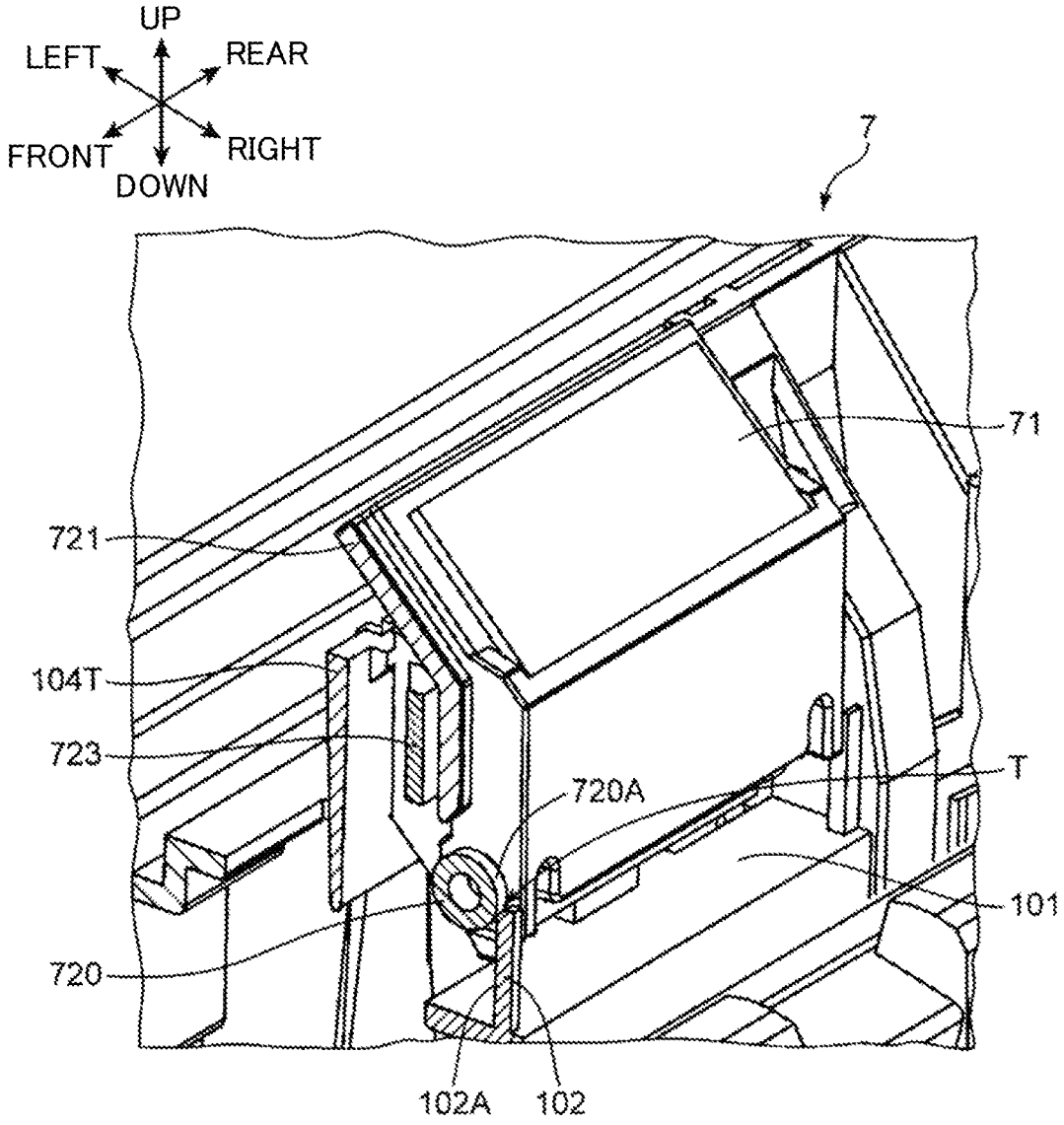
FIG. 12 is a cross-sectional perspective view showing how the holder is mounted to the mount portion, according to the embodiment of the present disclosure.
Figure 13:
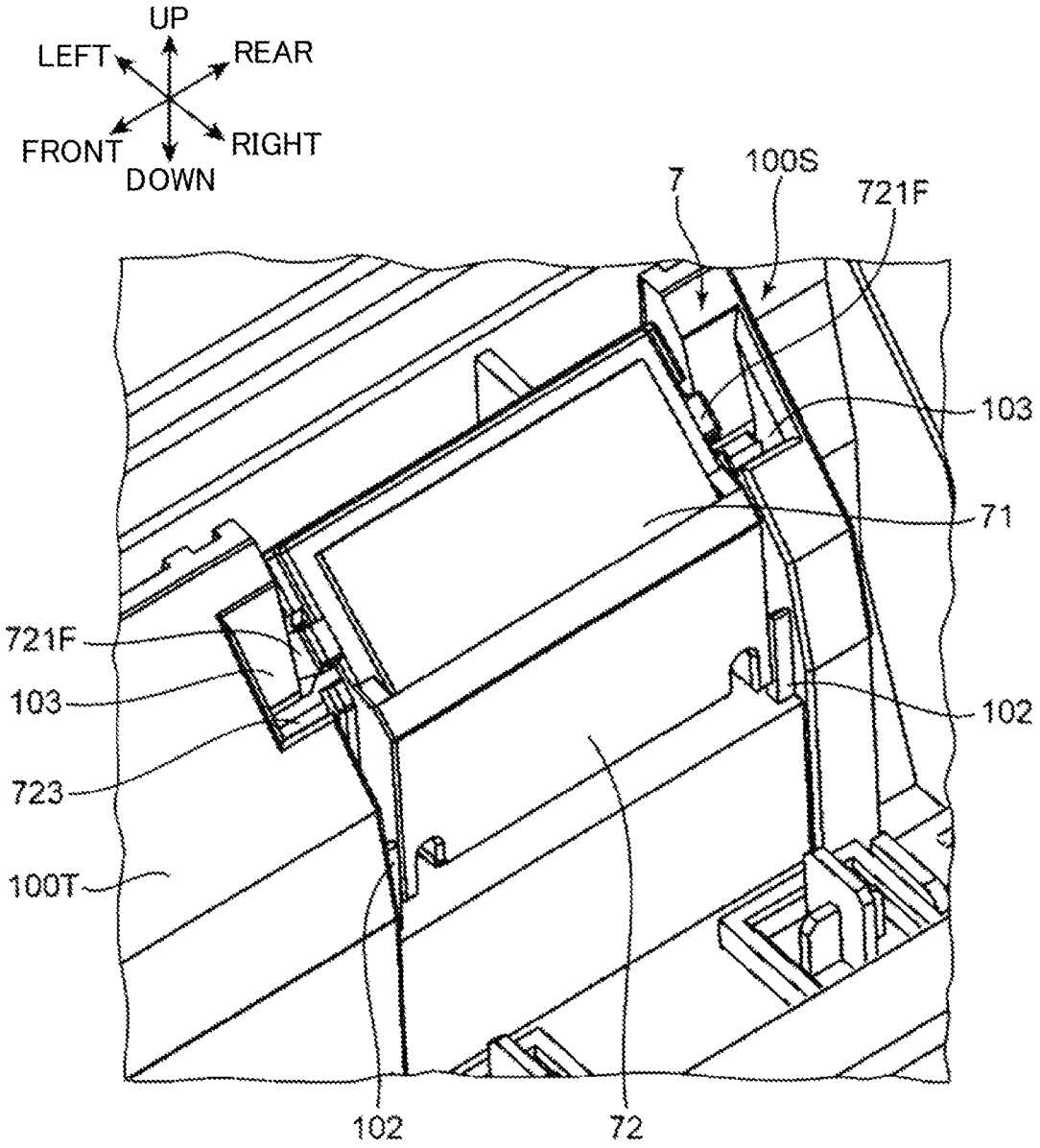
FIG. 13 is a perspective view showing a state where the holder is in its second posture in the mount portion, according to the embodiment of the present disclosure.
Figure 14:
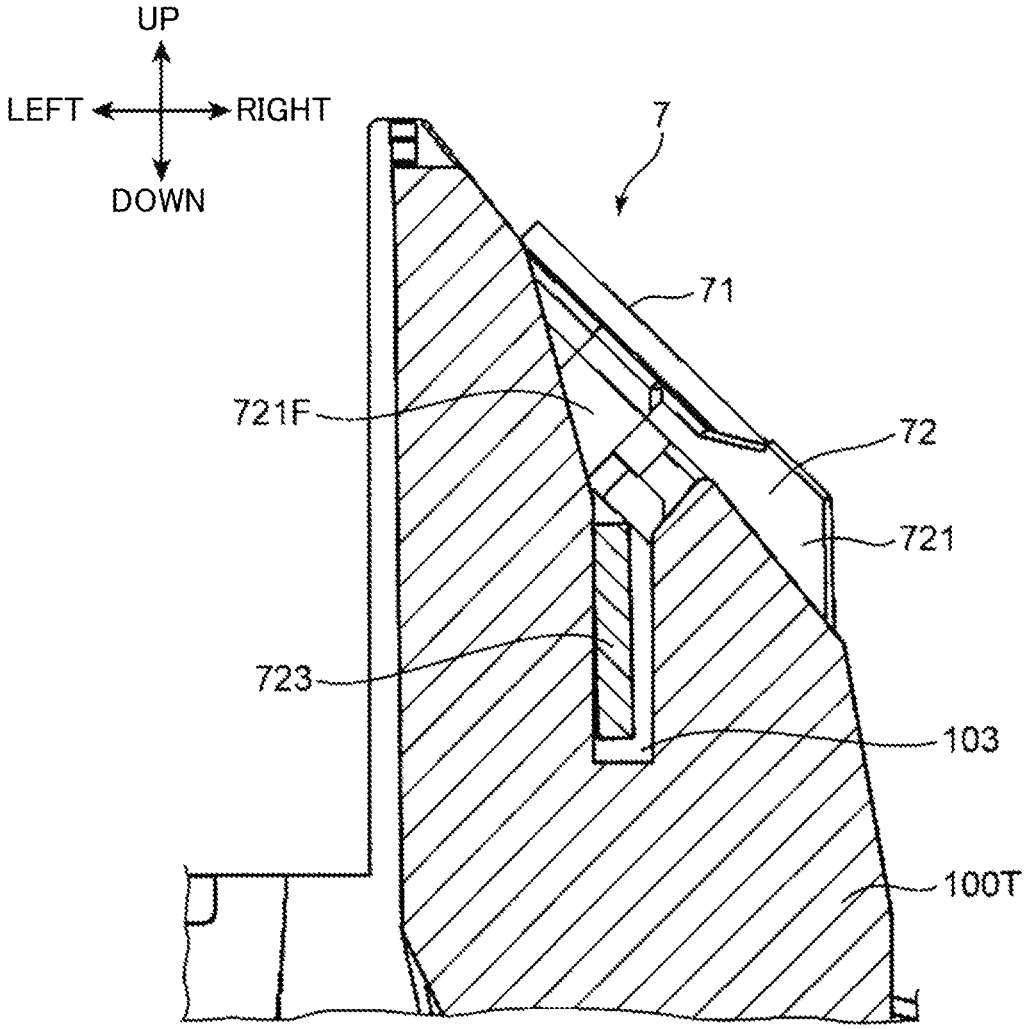
FIG. 14 is a cross-sectional view showing a state where the holder is in the second posture in the mount portion, according to the embodiment of the present disclosure.
Figure 15:
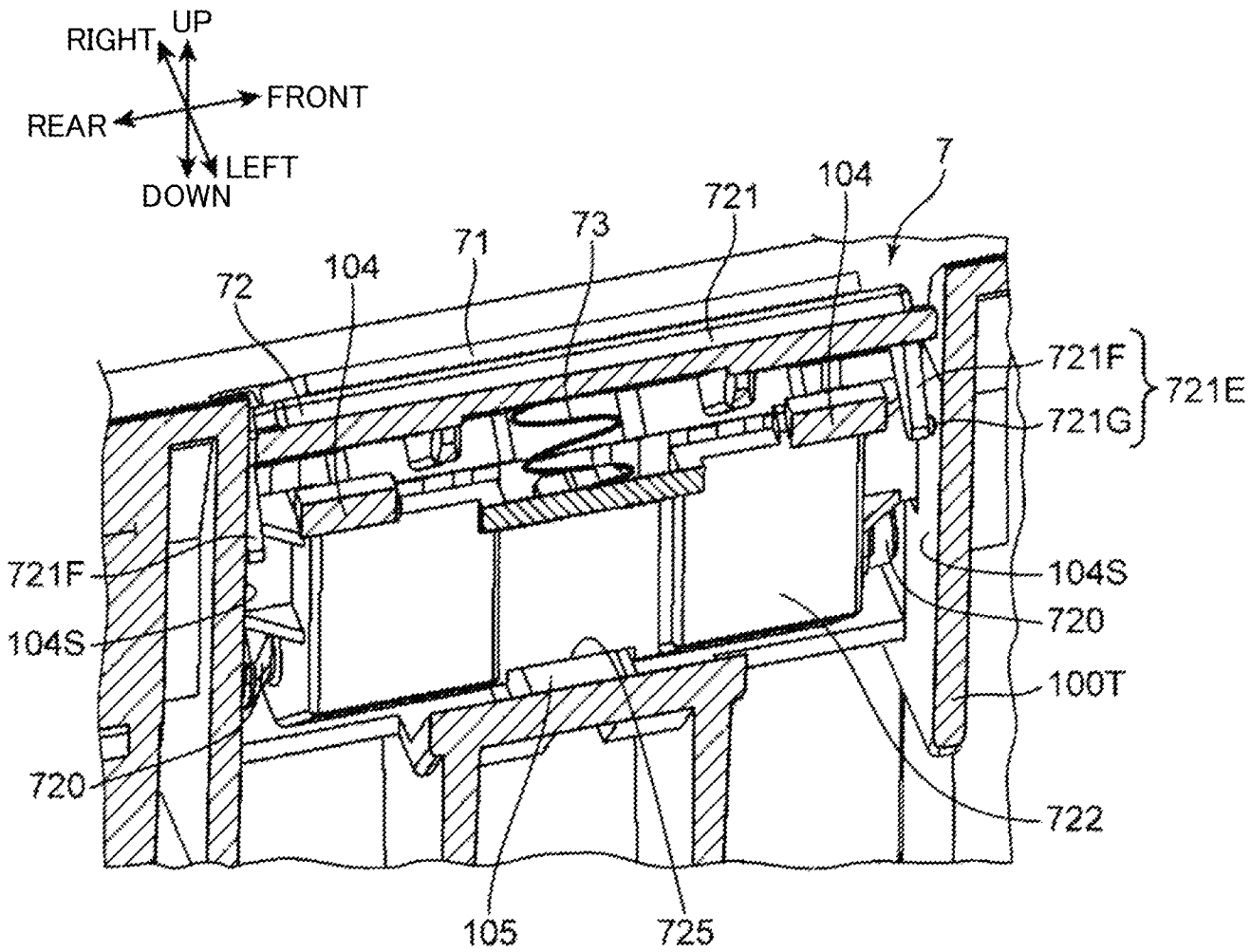
FIG. 15 is a cross-sectional perspective view showing a state where the holder is in the second posture in the mount portion, according to the embodiment of the present disclosure.
Figure 16:
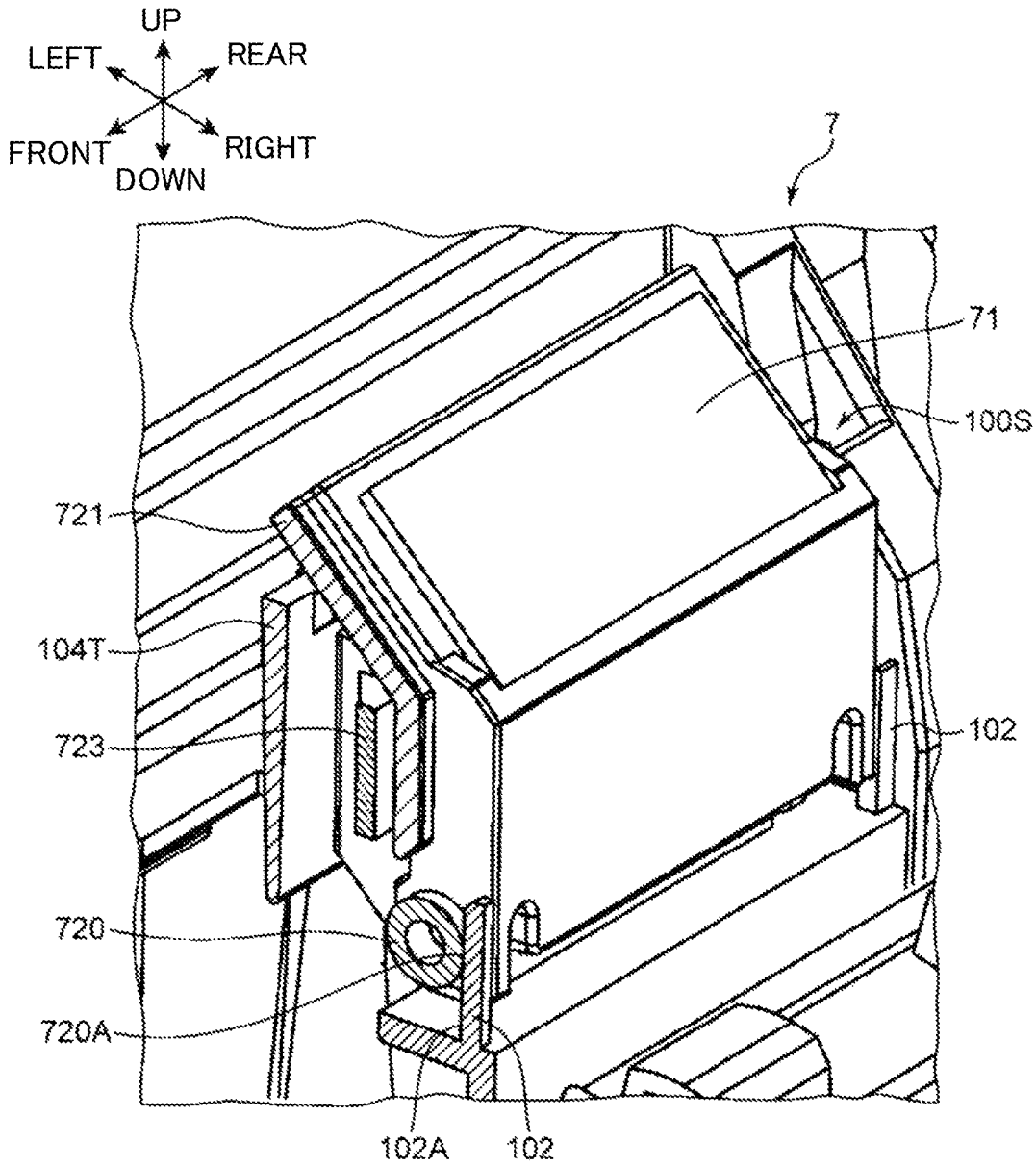
FIG. 16 is a cross-sectional perspective view showing a state where the holder is in the second posture in the mount portion, according to the embodiment of the present disclosure.

Hereinafter, how to mount/remove the pad holder 72 to/from the mount portion 100S will be described with reference to FIGS. 10 to 16 in addition to FIGS. 8 and 9. FIG. 10 is a perspective view showing the pad holder 72 in the first posture being mounted in the mount space 101 of the mount portion 100S. FIG. 11 is a cross-sectional view showing the pad holder 72 in the first posture being mounted in the mount space 101 of the mount portion 100S. FIG. 12 is a cross-sectional perspective view showing how to mount the pad holder 72 to the mount portion 100S, particularly, showing the relationship between the cylindrical part 720 and the main body guide pieces 102. FIG. 13 is a perspective view showing the pad holder 72 being in the second posture in the mount portion 100S. FIG. 14 is a cross-sectional view showing the pad holder 72 being in the second posture in the mount portion 100S. FIG. 15 is a cross-sectional perspective view showing the pad holder 72 being in the second posture in the mount portion 100S, seen from the left side. FIG. 16 is a cross-sectional perspective view showing the pad holder 72 being in the second posture in the mount portion 100S, seen from the right side.

With reference to FIG. 2, when the sheet feed roller 461 is removed upward from the insertion space 46S of the housing 46H, the separation pad portion 7 is exposed upward in the insertion space 46S. Then, the pad holder 72 is mountable to and removable from the mount portion 100S in the up-down direction via the insertion space 46S. Thus, in the present embodiment, the sheet feed roller 461 and the pad holder 72 are mounted/removed in the same direction by using the insertion space 46S of the housing 46H. Therefore, the operability in mounting/removing the sheet feed roller 461 and the pad holder 72 is improved.

With reference to FIGS. 7 and 8, the pad holder 72 is mounted to or removed from the mount portion 100S in a state where the distance between the first holder portion 21 and the second holder portion 722 is greatest around the rotation axis line CL due to the urging force of the urging spring 73. The posture of the pad holder 721 at this time is defined as the first posture (refer to FIGS. 10 and 11).

When the pad holder 72 is mounted to the mount portion 100S from above, the guide pieces 723 projecting from the second holder portion 722 are inserted into the guide grooves 103. In addition, the pad holder 72 is guided by the wall surfaces 102A of the main body guide pieces 102 while sliding along the wall surfaces 102A. Specifically, as shown in FIG. 12, in a state where a predetermined gap T can be formed between each wall surface 102A and the outer circumferential surface 720A of the cylindrical part 720 of the first holder portion 721, the pad holder 72 in the first posture is mounted to the mount portion 100S while the outer circumferential surface 720A is guided by the wall surface 102A. Therefore, when the pad holder 72 is mounted to the mount portion 100S, the outer circumferential surface 720A and the wall surface 102A are prevented from strongly rubbing each other. Accordingly, the pad holder 72 is smoothly inserted in the mount portion 100S. Particularly, since the outer circumferential surface 720A of the cylindrical part 720 is guided by the wall surface 102A of the main body guide piece 102, the contact area between the outer circumferential surface 720A and the wall surface 102A is reduced due to the circumferential shape of the outer circumferential surface 720A, thereby further preventing the outer circumferential surface 720A and the wall surface 102A from strongly rubbing each other. Although in FIG. 12 the first holder portion 721 looks like parallel to the guide piece 723 of the second holder portion 722, actually the first holder portion 721 is mounted in or removed from the mount space 101 while being inclined rightward around the rotation axis line CL as shown in FIGS. 10 and 11. Even if the angle of the first holder portion 721 with respect to the second holder portion 722 is changed, since the cylindrical part 720 has the cylindrical shape, any area of the outer circumferential surface 720A of the cylindrical part 720 can constantly face the wall surface 102A of the main body guide pieces 102. As a result, the pad holder 72 is stably guided inward and outward the mount space 101 by the main body guide pieces 102.

When the pad holder 72 is mounted in the mount space 101 of the mount portion 100S, the second holder portion 722 of the pad holder 72 is fixed to the wall part 104T (refer to FIG. 9) of the mount portion 100S. On the other hand, in the mount space 101 of the mount portion 100S, the first holder portion 721 is rotatable with respect to the second holder portion 722. In this state, as shown in FIG. 10, the hemisphere portion 721G of the contact part 721E projecting from the first holder portion 721 is disposed so as to face the guide groove 103. In addition, the hemisphere portion 721G does not contact any wall part of the mount portion 100S before the pad holder 72 is mounted in the mount space 101. That is, the hemisphere portion 721G is spaced apart from the mount portion 100S. Therefore, mounting of the pad holder 72 in the mount space 101 is not prevented by the hemisphere portion 721G (contact part 721E).

After the pad holder 72 is mounted in the mount space 101 as described above, the sheet feed roller 461 is mounted in the insertion space 46S (refer to FIG. 2) of the housing 46H disposed above the mount portion 100S. At this time, the sheet feed roller 461 presses the separation pad 71 downward against the urging force of the urging spring 73 (refer to FIG. 8). Thereby, the first holder portion 721 rotates around the rotation axis line CL so as to come close to the second holder portion 722. As a result, the posture of the pad holder 72 changes from the first posture to the second posture. That is, mounting of the sheet feed roller 461 to the housing 46H realizes a change in the posture of the pad holder 72.

In the second posture, the contact pieces 724 (refer to FIG. 7) of the second holder portion 722 contact the upper support parts 104 (refer to FIG. 9) of the mount portion 100S, and the guide pieces 723 of the second holder portion 722 contact one surface of the guide grooves 103 of the mount portion 100S (refer to FIG. 14). Thereby, the second holder portion 722 is fixed to the mount portion 100S. Then, the urging spring 73 urges the separation pad 71 toward the sheet feed roller 461 via the first holder portion 721. Therefore, the nip portion is stably formed.

In the present embodiment, when the first holder portion 721 rotates around the rotation axis line CL, the pad holder 72 changes its posture from the first posture to the second posture (refer to FIGS. 13 and 14) while the hemisphere portions 721G frictionally slide on the inner wall parts 104S (refer to FIG. 9). Then, in the second posture of the pad holder 72, the hemisphere portions 721G contact the inner wall parts 104S along the sheet width direction (refer to FIG. 15). Specifically, of the pair of hemisphere portions 721G, the hemisphere portion 721G of the front-side contact part 721E faces forward and contacts the inner wall part 104S. On the other hand, the hemisphere portion 721G (not shown in FIG. 15) of the rear-side contact part 721E faces backward and contacts the inner wall part 104S. Thus, the pair of hemisphere portions 721G contact the pair of inner wall parts 104S, thereby restricting the position of the pad holder 72 in the sheet width direction.

Accordingly, during the sheet feeding operation for feeding a sheet from the manual feed tray 46A, vibration of the pad holder 72 caused when the sheet passes through the nip portion is reduced by the contact of the hemisphere portions 721G with the inner wall parts 104S. As a result, abnormal sound caused when the sheet passes through the nip portion is suppressed. In the present embodiment, as described above, the hemisphere portions 721G are in contact with the inner wall parts 104S in the sheet width direction. Therefore, the first holder portion 721 supporting the separation pad 71 is allowed to rotate around the rotation axis line CL with the hemisphere portions 721G sliding along the inner wall parts 104S while being in contact with the inner wall parts 104S. Therefore, the first holder portion 721 is not fixed due to the contact of the hemisphere portions 721G of the contact parts 721E with the mount portion 100S, thereby preventing formation of a nip portion from being hindered.

Additionally, when a sheet passes through the nip portion, dynamic frication force and static friction force might vary between the sheet feed roller 461, the sheet, and the separation pad 71. As a result, the rotation speed of the sheet feed roller 461 might vary. When the rotation speed of the sheet feed roller 461 varies, the first holder portion 721 including the separation pad 71 vibrates, and abnormal sound is likely to occur. In the present embodiment, however, as described above, even when a sheet passes through the nip portion, the hemisphere portions 721G are in contact with the inner wall parts 104S. Therefore, the rigidity of the first holder portion 721 is increased, and the above-mentioned vibration of the first holder portion 721 is suppressed. Further, also in this case, the first holder portion 721 is allowed to rotate around the rotation axis line CL with the hemisphere portions 721G sliding along the inner wall parts 104S while being in contact with the inner wall parts 104S. Therefore, the sheet is allowed to pass through the nip portion stably while maintaining the state where the hemisphere portions 721G are constantly in contact with the inner wall parts 104S. In other words, if rotation of the first holder portion 721 is hindered by the contact of the hemisphere portions 721G with the inner wall parts 104S, the sheet feeding performance at the nip portion is degraded. On the other hand, in the present embodiment, since the direction in which the hemisphere portions 721G contact the wall parts 104S is the sheet width direction, rotation of the first holder portion 721 is prevented from being hindered. The contact parts 721E may be disposed on the second holder portion 722 side. On the other hand, when the contact parts 721E are disposed on the first holder portion 721 side like the separation pad 71 as in the present embodiment, vibration caused when a sheet passes through the nip portion is efficiently reduced before being transferred to the other members.

Further, in the present embodiment, rotation of the first holder portion 721 realizes movement of the contact part 721E. Then, the pad holder 72 changes its posture from the first posture to the second posture while the hemisphere portions 721G frictionally slide on the inner wall parts 104S. Therefore, the hemisphere portions 721G are allowed to stably contact the inner wall parts 104S before the pad holder 72 reaches the second posture. At this time, the extending portions 721F are elastically deformed with the hemisphere portions 721G being free ends, whereby the hemisphere portions 721G can smoothly move while being in contact with the inner wall parts 104S. In addition, during the sheet feeding operation, vibration caused when a sheet passes through the nip portion is likely to be absorbed by the elastic deformation of the extending portions 721F.

Further, in the present embodiment, the hemispherical shape of the hemisphere portion 721G reduces sliding resistance when the hemisphere portions 721G frictionally slide on the inner wall parts 104S. In addition, an elastic force caused by the elastic deformation of the extending portions 721F allows the hemisphere portions 721G to stably contact the inner wall parts 104S.

In the first posture of the pad holder 72 shown in FIG. 10, it is desired that the hemisphere portions 721G are disposed slightly outside with respect to the inner wall parts 104S in the sheet width direction. In other words, in the first posture, the interval between the pair of hemisphere portions 721G in the sheet width direction is desirably set to be slightly larger than the interval between the pair of inner wall parts 104S. In this case, after the circumferential surface of each hemisphere portion 721G contacts a right-side edge of the inner wall part 104S with rotation of the first holder portion 721, the hemisphere portion 721G frictionally slides on the inner wall part 104S while the extending portion 721F elastically deforms inward in the sheet width direction. Accordingly, contact of the hemisphere portion 721G with the inner wall part 104S is reliably and smoothly realized.

In addition, in the present embodiment, with the change in the posture of the pad holder 72 to the second posture, the outer circumferential surface 720A of each cylindrical part 720 is pressed against (comes into contact with) the wall surface 102A of the main body guide piece 102 in the rightward direction (refer to FIG. 16). In other words, after the pad holder 72 is mounted to the mount portion 100S, the cylindrical part 720 disposed beneath the separation pad 71 is brought into contact with the wall surface 102A of the main body guide pieces 102 in the rightward direction, by utilizing a reaction force of a force caused when the sheet feed roller 461 presses the separation pad 71 supported by the pad holder 72 downward and leftward. Therefore, vibration caused when a sheet passes through the nip portion during the sheet feeding operation is further reduced by the contact of the pad holder 72 with the main body guide pieces 102. As a result, occurrence of abnormal sound caused when a sheet passes through the nip portion is further suppressed. Particularly, in the present embodiment, the outer circumferential surface 720A of the cylindrical parts 720 contact the wall surfaces 102A of the main body guide pieces 102. Therefore, each outer circumferential surface 720A comes into point-contact with the wall surface 102A when viewed at a cross section intersecting the cylindrical axis of the cylindrical part 720. As a result, the outer circumferential surfaces 720A can reliably contact the wall surface 102A. Further, contact of the pad holder 72 with the main body guide pieces 102 allows the position of the separation pad 71 to be stably maintained. As a result, the position of the nip portion between the separation pad 71 and the sheet feed roller 461 is less likely to change, and thus the manually-fed-sheet conveying path 460 is stably maintained.

Furthermore, in the present embodiment, the cylindrical parts 720 are disposed on the first holder portion 721 side of the pad holder 72, while the guide pieces 723 are disposed on the second holder portion 722 side. Accordingly, even in the pad holder 72 composed of two plate-shaped members being combined, the guide members (the cylindrical parts 720 and the guide pieces 723) are disposed on both the first holder portion 721 and the second holder portion 722, and thus mounting/removal of the pad holder 72 is realized more stably.

The manual sheet feed portion 46 (manual feed tray 46A) according to the embodiment of the present disclosure and the image forming apparatus 1 including the manual sheet feed portion 46, have been described. In the image forming apparatus 1, an image can be stably formed on a sheet while suppressing abnormal sound caused when the sheet passes through the nip portion. However, the present disclosure is not limited thereto. For example, the following modifications are also within the scope of the present disclosure.

In the above embodiment, the manual feed tray 46A is used as a sheet tray, and the manual sheet feed portion 46 is used as a sheet feed apparatus. However, the present disclosure is not limited thereto. The present disclosure may be applied to an automatic document feeder 20 (sheet feed apparatus) as a sheet feed apparatus that conveys a sheet as a document sheet. In this case, an image reading apparatus 2 is constituted by the reading unit 25 (reading portion) and the automatic document feeder 20. The reading unit 25 is disposed facing the sheet conveying path extending from the document tray 21 (sheet stacking portion). A sheet feed roller, a separation pad 71, and a pad holder 72, similar to those of the above embodiment, are disposed in the document conveying portion 22 of the automatic document feeder 20. Also in this case, the pad holder 72 supporting the separation pad 71 is smoothly mounted to a predetermined mount portion. Further, vibration caused when a document sheet passes through a nip portion during a sheet feeding operation for feeding the document sheet from the document tray 21 is preferably suppressed by contact of a not-illustrated contact part with the mount portion. As a result, an image on the document sheet can be stably read while abnormal sound caused when the document sheet passes through the nip portion is suppressed.

In the above embodiment, a portion of the contact part 721E, which contacts the inner wall part 104S, has a hemispherical shape. However, the present disclosure is not limited thereto. The contact part may have another shape. When the contact part 721E has a wedge shape tapered toward the rotation direction of the first holder portion 721, contact of the wedge-shaped contact part with the inner wall part 104S prevents vibration of the pad holder 72 and occurrence of abnormal sound.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed apparatus comprising:

a casing;

a sheet stacking portion provided in the casing, in which sheets are stacked;

a sheet conveying path through which the sheets stacked in the sheet stacking portion are conveyed in a predetermined sheet conveying direction;

a sheet feed roller provided in the casing so as to face a downstream side of the sheet stacking portion in the sheet conveying direction, and configured to convey the sheets in the sheet conveying direction;

a separation pad provided facing the sheet feed roller, and configured to form, with the sheet feed roller, a nip portion through which the sheets pass, and convey the sheets one by one in the sheet conveying direction;

a holder configured to fix and support the separation pad;

a mount portion provided in the downstream side from the sheet stacking portion in the sheet conveying direction in the casing, to and from which the holder is mountable and removable; and an urging member configured to urge the separation pad toward the sheet feed roller via the holder being in a mounted state where the holder is mounted to the mount portion, wherein the holder is configured to be changeable in its posture between a first posture and a second posture, the first posture being a posture in which the separation pad is spaced apart from the sheet feed roller so as to release the nip portion while the holder is in the mounted state, and the second posture being a posture in which the nip portion is formed between the separation pad and the sheet feed roller while the holder is in the mounted state, the holder includes a contact part that contacts the mount portion when the holder is in the second posture, and is spaced apart from the mount portion when the holder is in the first posture, the mount portion includes an inner wall which defines a mount space in which the holder is mounted, and faces the holder in a sheet width direction intersecting the sheet conveying direction, when the holder is in the second posture, the contact part comes into contact with the inner wall;

the holder includes:

a first supporting plate supporting the separation pad; and a second supporting plate mounted to the mount portion, and rotatably supporting the first supporting plate, the urging member is compressed and disposed between the first supporting plate and the second supporting plate, the first supporting plate includes, at a lower end thereof, a hole opened facing the sheet width direction, the second supporting plate includes, at a lower end thereof, a shaft which extends in the sheet width direction and can be inserted in the hole, and when the shaft is inserted in the hole, the first supporting plate becomes rotatable around the shaft as a rotation axis with respect to the second supporting plate, and the contact part is disposed on the first supporting plate.

2. The sheet feed apparatus according to claim 1, wherein the sheet feed roller is mountable and removable in the casing, the first posture of the holder is a state where a distance between the first supporting plate and the second supporting plate around the rotation axis is greatest due to an urging force of the urging member, and when the holder is mounted in the mount space and the sheet feed roller is mounted to the casing, the first supporting plate rotates around the shaft as a rotation axis so as to come close to the second supporting plate, against the urging force of the urging member, whereby the posture of the holder is changed from the first posture to the second posture.

3. The sheet feed apparatus according to claim 2, further comprising:

a cylindrical part provided so as to project in the sheet width direction from a portion of the holder lower than the separation pad, and including an outer circumferential surface; and a guide member disposed, in the mount portion, between the holder and the sheet stacking portion, including a wall surface extending in an up-down direction and facing the holder, and configured to guide the holder to the mount space, wherein the holder is mounted in the mount space while the outer circumferential surface of the cylindrical part is guided by the wall surface of the guide member, and when the holder is in the second posture, the outer circumferential surface of the cylindrical part is pressed against the wall surface.

4. The sheet feed apparatus according to claim 2, wherein the casing includes, in a region above the mount portion, a housing having a storage space in which the sheet feed roller is stored, and supporting the sheet feed roller, the sheet feed roller is mounted in and removed from the storage space of the housing via an upper portion of the storage space, and the holder is mounted to and removed from the mount portion via the storage space from which the sheet feed roller has been removed.

5. The sheet feed apparatus according to claim 2, wherein the holder further includes a guide plate provided so as to projects from the second supporting plate in the sheet width direction, and the mount portion further includes a guide groove in which the guide plate is inserted.

6. The sheet feed apparatus according to claim 1, wherein the contact part includes:

an extending portion provided so as to project from an end of the first supporting plate in the sheet width direction toward the second supporting plate side, the extending portion being elastically deformable in the sheet width direction; and a projecting portion provided so as to project from a front end of the extending portion in the sheet width direction, the projecting portion being in contact with the inner wall, and when the holder is in the second posture, the first supporting plate rotates around the shaft as a rotation axis while the projecting portion frictionally slides on the inner wall, with passing of the sheets through the nip portion.

7. The sheet feed apparatus according to claim 6, wherein the projecting portion has a hemispherical shape.

8. An image forming apparatus comprising:

the sheet feed apparatus according to claim 1 configured to convey the sheet; and an image forming portion provided in the casing, and configured to form an image on the sheet conveyed by the sheet feed apparatus.

9. An image reading apparatus comprising:

the sheet feed apparatus according to claim 1 configured to convey the sheet as a document sheet; and a reading portion provided facing the sheet conveying path, and configured to read an image on the document sheet.

10. A sheet feed apparatus comprising:

a casing;

a sheet stacking portion provided in the casing, in which sheets are stacked;

a sheet conveying path through which the sheets stacked in the sheet stacking portion are conveyed in a predetermined sheet conveying direction;

a sheet feed roller provided in the casing so as to face a downstream side of the sheet stacking portion in the sheet conveying direction, and configured to convey the sheets in the sheet conveying direction;

a separation pad provided facing the sheet feed roller, and configured to form, with the sheet feed roller, a nip portion through which the sheets pass, and convey the sheets one by one in the sheet conveying direction;

a holder configured to fix and support the separation pad;

a mount portion provided in the downstream side from the sheet stacking portion in the sheet conveying direction in the casing, to and from which the holder is mountable and removable; and an urging member configured to urge the separation pad toward the sheet feed roller via the holder being in a mounted state where the holder is mounted to the mount portion, wherein the holder is configured to be changeable in its posture between a first posture and a second posture, the first posture being a posture in which the separation pad is spaced apart from the sheet feed roller so as to release the nip portion while the holder is in the mounted state, and the second posture being a posture in which the nip portion is formed between the separation pad and the sheet feed roller while the holder is in the mounted state, the holder includes a contact part that contacts the mount portion when the holder is in the second posture, the mount portion includes an inner wall which defines a mount space in which the holder is mounted, and faces the holder in a sheet width direction intersecting the sheet conveying direction, when the holder is in the second posture, the contact part comes into contact with the inner wall, the holder includes:

a first supporting plate supporting the separation pad; and a second supporting plate mounted to the mount portion, and rotatably supporting the first supporting plate, the urging member is compressed and disposed between the first supporting plate and the second supporting plate, the first supporting plate includes, at a lower end thereof, a hole opened facing the sheet width direction, the second supporting plate includes, at a lower end thereof, a shaft which extends in the sheet width direction and can be inserted in the hole, and when the shaft is inserted in the hole, the first supporting plate becomes rotatable around the shaft as a rotation axis with respect to the second supporting plate, and the contact part is disposed on the first supporting plate.

11. The sheet feed apparatus according to claim 10, wherein the sheet feed roller is mountable and removable in the casing, the first posture of the holder is a state where a distance between the first supporting plate and the second supporting plate around the rotation axis is greatest due to an urging force of the urging member, and when the holder is mounted in the mount space and the sheet feed roller is mounted to the casing, the first supporting plate rotates around the shaft as a rotation axis so as to come close to the second supporting plate, against the urging force of the urging member, whereby the posture of the holder is changed from the first posture to the second posture.

12. The sheet feed apparatus according to claim 11, further comprising:

a cylindrical part provided so as to project in the sheet width direction from a portion of the holder lower than the separation pad, and including an outer circumferential surface; and a guide member disposed, in the mount portion, between the holder and the sheet stacking portion, including a wall surface extending in an up-down direction and facing the holder, and configured to guide the holder to the mount space, wherein the holder is mounted in the mount space while the outer circumferential surface of the cylindrical part is guided by the wall surface of the guide member, and when the holder is in the second posture, the outer circumferential surface of the cylindrical part is pressed against the wall surface.

13. The sheet feed apparatus according to claim 11, wherein the casing includes, in a region above the mount portion, a housing having a storage space in which the sheet feed roller is stored, and supporting the sheet feed roller, the sheet feed roller is mounted in and removed from the storage space of the housing via an upper portion of the storage space, and the holder is mounted to and removed from the mount portion via the storage space from which the sheet feed roller has been removed.

14. The sheet feed apparatus according to claim 11, wherein the holder further includes a guide plate provided so as to projects from the second supporting plate in the sheet width direction, and the mount portion further includes a guide groove in which the guide plate is inserted.

15. The sheet feed apparatus according to claim 10, wherein the contact part includes:

an extending portion provided so as to project from an end of the first supporting plate in the sheet width direction toward the second supporting plate side, the extending portion being elastically deformable in the sheet width direction; and a projecting portion provided so as to project from a front end of the extending portion in the sheet width direction, the projecting portion being in contact with the inner wall, and when the holder is in the second posture, the first supporting plate rotates around the shaft as a rotation axis while the projecting portion frictionally slides on the inner wall, with passing of the sheets through the nip portion.

16. The sheet feed apparatus according to claim 15, wherein the projecting portion has a hemispherical shape.

* * * * *